US012029947B1

(12) United States Patent
Hobbs et al.

(10) Patent No.: US 12,029,947 B1
(45) Date of Patent: Jul. 9, 2024

(54) GOLF CLUB HEAD

(71) Applicant: Cobra Golf Incorporated, Carlsbad, CA (US)

(72) Inventors: Bryce W. Hobbs, Carlsbad, CA (US); Ryan L. Roach, Encinitas, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 17/892,630

(22) Filed: Aug. 22, 2022

(51) Int. Cl.
*A63B 53/04* (2015.01)

(52) U.S. Cl.
CPC ..... *A63B 53/042* (2020.08); *A63B 53/045* (2020.08); *A63B 53/0487* (2013.01)

(58) Field of Classification Search
CPC ..... A63B 53/0416; A63B 53/042; A63B 53/0425; A63B 53/0487
USPC ..... 473/324–350
See application file for complete search history.

(56) References Cited

U.S. PATENT DOCUMENTS 3,989,248 A * 11/1976 Campau ..... A63B 53/0466 473/329
5,766,094 A * 6/1998 Mahaffey ..... A63B 60/00 473/347
6,193,615 B1 * 2/2001 Hirota ..... A63B 53/04 473/331
7,281,990 B2 * 10/2007 Hagood ..... A63B 53/04 473/332
7,651,408 B2 * 1/2010 Hagood ..... A63B 60/00 473/332
8,747,245 B2 * 6/2014 Franklin ..... A63B 60/00 473/331
8,790,192 B2 * 7/2014 Narita ..... A63B 53/0487 473/340
9,694,260 B1 * 7/2017 Abbott ..... A63B 60/00
9,808,681 B2 * 11/2017 Takechi ..... A63B 60/50
9,889,347 B2 * 2/2018 Morales ..... A63B 53/0466
10,668,338 B2 * 6/2020 Morales ..... A63B 60/02
11,524,213 B1 * 12/2022 Roach ..... B22F 5/10
11,618,079 B1 * 4/2023 Roach ..... B33Y 10/00
11,618,213 B1 * 4/2023 Roach ..... B22F 10/40
2005/0009623 A1 * 1/2005 Dickinson ..... A63B 53/04 473/331
2005/0020378 A1 * 1/2005 Krumme ..... A63B 53/04 473/340
2007/0243949 A1 * 10/2007 Solari ..... A63B 53/08 473/340
2010/0087269 A1 * 4/2010 Snyder ..... A63B 60/00 473/331

(Continued)

FOREIGN PATENT DOCUMENTS

CN 102847285 A * 1/2013 ..... A63B 53/04
GB 2444176 A * 5/2008 ..... A63B 53/04

(Continued)

*Primary Examiner* — Alvin A Hunter
(74) *Attorney, Agent, or Firm* — Quarles & Brady LLP

(57) ABSTRACT

A golf club head includes a body having a crown that is opposite a sole, a toe region, a heel region, a medial region extending between the toe region and the heel region, and an insert cavity at a front side. The golf club head further includes a face insert that has front wall, a rear wall, and a core. The core includes a plurality of channels extending concavely relative to the sole from the heel region to the toe region.

22 Claims, 14 Drawing Sheets

(56) References Cited

U.S. PATENT DOCUMENTS

| | | | | |
|---|---|---|---|---|
| 2010/0113184 | A1* | 5/2010 | Kuan | A63B 60/54 473/340 |
| 2012/0157226 | A1* | 6/2012 | Narita | A63B 53/0487 473/329 |
| 2012/0184392 | A1* | 7/2012 | Narita | A63B 60/52 473/340 |
| 2013/0072321 | A1* | 3/2013 | Morales | B23K 20/233 228/159 |
| 2014/0323237 | A1* | 10/2014 | Beno | A63B 53/04 72/352 |
| 2016/0263449 | A1* | 9/2016 | Morales | B23K 20/233 |
| 2018/0178094 | A1* | 6/2018 | Morales | A63B 53/0475 |
| 2020/0038717 | A1* | 2/2020 | Stubben | A63B 53/0487 |
| 2020/0368588 | A1* | 11/2020 | Morales | A63B 53/04 |
| 2021/0069556 | A1* | 3/2021 | Morales | B23K 20/023 |
| 2021/0077865 | A1* | 3/2021 | Morales | B23K 20/233 |
| 2022/0161105 | A1* | 5/2022 | Morales | B23K 20/233 |

FOREIGN PATENT DOCUMENTS

| | | | | | |
|---|---|---|---|---|---|
| JP | 2012010767 | A | * | 1/2012 | A63B 53/0487 |
| JP | 2013013752 | A | * | 1/2013 | A63B 53/0408 |
| KR | 100642166 | B1 | * | 11/2006 | |
| KR | 20080047955 | A | * | 5/2008 | |
| KR | 200441892 | Y1 | * | 9/2008 | |

* cited by examiner

GOLF CLUB HEAD

CROSS REFERENCE TO RELATED APPLICATIONS

Not applicable.

REFERENCE REGARDING FEDERALLY SPONSORED RESEARCH OR DEVELOPMENT

Not applicable.

SEQUENCE LISTING

Not applicable.

BACKGROUND

1. Field of the Disclosure

The present disclosure relates to golf clubs, and more specifically to a golf club head that includes a face insert.

2. Description of the Background of the Disclosure

Different types of golf clubs are used to effect different types of shots, based on a golfer's location and ball lie when playing a hole on a golf course. Each club has different overall structure, which is dependent upon the purpose of the club, but the club heads of all golf clubs comprise a face having a striking surface, which defines a striking profile that is commensurate with the underlying purpose of each respective club head. The striking surface of each club head is constructed based upon a number of factors, such as the intended contact speed with a golf ball, the desired acoustic and vibratory feedback for the golfer using the club head, and the required regulatory framework as set forth by various regulatory bodies, including the United States Golf Association ("USGA"), among other factors.

For putters, the striking surface is constructed to provide enhanced accuracy and precision at low striking speeds, thereby increasing a golfer's chances of sinking a putt at any location from which a putt is an appropriate shot on a golf course. While striking surfaces of putters have an overall profile that is generally planar, golf balls are not perfectly spherical objects since they are covered in dimples, making the surface of golf balls substantially uneven. As a result, when striking the golf ball with a typical putter, the ball can bounce off at unintended or unexpected angles. Additionally, if the ball is not hit in the center of the club face, the resulting roll path of the ball may differ from a centerline path. Each of these situations may be referred to as a mishit. At longer distances, a resultant putt that is off by even one degree can result in a missed putt.

In addition to the end result of reducing mishits taken with a putter, other important considerations for putters include the tactile and acoustic feedback to the golfer. Successful prior art putter-type golf clubs provide a positive sensation or feel that the golf club is delivering for the golfer. Since many putter-type golf clubs include metal striking faces, a metallic feel can be associated with harsh sensations for off-center shots.

Therefore, a need exists for a putter that can reduce mishits, especially for longer putts, provide desirable auditory and vibratory feedback to a golfer, and be manufactured in an efficient and cost-effective manner.

SUMMARY

In some aspects, a golf club head includes a body including a crown that is opposite a sole, a heel region, a toe region, a medial region extending between the heel region and the toe region, and an insert cavity at a front side. The golf club head further includes a face insert having a front wall, a rear wall, and a core. The face insert defines a periphery that includes a lower edge that is configured to be disposed parallel with a ground surface when the golf club head is at address, and the core includes a plurality of channels extending convexly relative to the sole from the heel region to the toe region.

In some embodiments, the body and the face insert are formed of different materials. In some embodiments, the core is formed by an additive manufacturing process. In some embodiments, the core extends continuously across the face insert. In some embodiments, when the face insert impacts a golf ball heelward of a geometric center, the core of the face insert is configured to impart a corrective cut spin, and when the face insert impacts a golf ball toeward of the geometric center, the core of the face insert is configured to impart a corrective draw spin a putter-type golf club head includes a body and a face insert. In some embodiments, the core includes a plurality of ribs that extend at an inclined angle between the front wall and the rear wall. In some embodiments, the plurality of channels comprise at least 40% of a face insert volume.

In some aspects, a golf club head includes a body including a crown that is opposite a sole, a toe region, a heel region, a medial region extending between the toe region and the heel region, and an insert cavity at a front side. The golf club head further includes a face insert that includes a front wall, a rear wall, and a core. The face insert defines a periphery that includes a bottom edge that is configured to be disposed parallel with a ground surface when the golf club head is at address. The rear wall includes a plurality of slots formed therethrough.

In some embodiments, the core is formed by an additive manufacturing process. In some embodiments, the core includes a plurality of ribs and a plurality of channels that curve downwardly toward the sole within the heel region and the toe region. In some embodiments, each slot of the plurality of slots is in fluid communication with at least one channel of the plurality of channels. In some embodiments, the core of the face insert is surrounded by and spaced inwardly from the periphery. In some embodiments, the plurality of ribs extend at an inclined angle between the front wall and the rear wall. In some embodiments, when the face insert impacts a golf ball heelward of a geometric center, the core of the face insert is configured to impart a corrective cut spin, and when the face insert impacts a golf ball toeward of the geometric center, the core of the face insert is configured to impart a corrective draw spin. In some embodiments, the periphery of the face insert includes a top edge that is opposite the bottom edge, and a thickness of the face insert varies between the top edge and the bottom edge.

In some aspects, a golf club head includes a body including a crown that is opposite a sole, a toe region, a heel region, a medial region that extends between the heel region and the toe region, and an insert cavity at a front side. The golf club head further includes a face insert including a front plate, a rear plate, and a core. The face insert defines a periphery that includes a bottom edge that is configured to be disposed parallel with a ground surface when the golf club head is at address, and the face insert defines a geometric center within the medial region. The face insert is received within the insert cavity of the body. The core includes a plurality of ribs extending at an angle relative to the sole in a longitudinal direction, e.g., front-to-back, between the front plate and the rear plate, and the plurality of ribs define a plurality of channels. At least one rib defines a dimension that is different from a corresponding dimension of at least one other rib.

In some embodiments, the plurality of ribs curve downwardly within the heel region and the toe region. In some embodiments, the plurality of channels comprise at least about 40% of a face insert volume. In some embodiments, the face insert is formed of a composite material having a hardness of less than 95 Shore A. In some embodiments, when the face insert impacts a golf ball heelward of the geometric center, the core of the face insert is configured to impart a corrective cut spin, and when the face insert impacts a golf ball toeward of the geometric center, the core of the face insert is configured to impart a corrective draw spin.

In some aspects, a golf club head includes a body including a crown that is opposite a sole, a toe region, a heel region, a medial region extending between the toe region and the heel region, and an insert cavity at a front side. In addition, the golf club head includes a face insert that includes a front wall and a core. The face insert defines a periphery that includes a lower edge that is configured to be disposed parallel with a ground surface when the golf club head is at address. The face insert comprises a plurality of openings in communication with the core. A portion of the insert cavity is configured to enclose at least one opening of the plurality of openings, and a portion of the periphery encloses the core between the front wall and the body.

In some embodiments, the plurality of openings are defined by a plurality of channels exposed on a rear side of the face insert. In some embodiments, the plurality of openings are formed through the periphery of the face insert. In some embodiments, the plurality of openings are in communication with a plurality of cavities of the core.

DETAILED DESCRIPTION OF THE DRAWINGS

Figure 1:
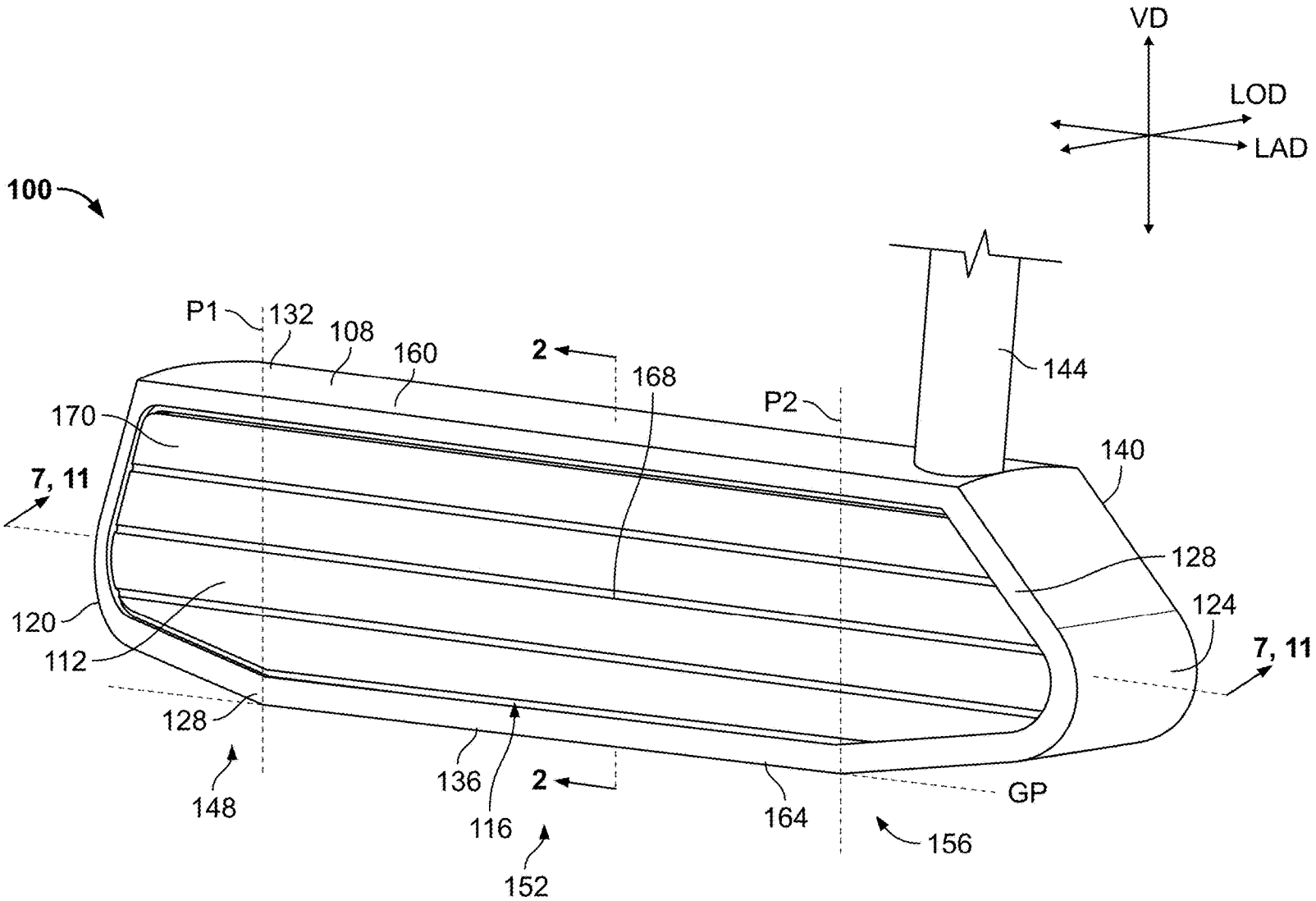
FIG. 1 is front, top, right isometric view of a golf club head including a face insert, according to an embodiment of the present disclosure.

The following discussion and accompanying figures disclose various embodiments or configurations of a golf club head having a face insert that assists golfers with reducing mishits of shots taken with a putter-type golf club. The face insert of the present disclosure further provides desirable acoustic and vibratory feedback to a golfer, which positively impacts a golfer's perception of hitting a golf ball with the same. As used herein, the terms "mass" and "weight" are used interchangeably, although it is understood that these terms refer to different properties in a strict physical sense. The term "about," as used herein, refers to variations in the numerical quantity that may occur, for example, through typical measuring and manufacturing procedures used for articles of manufacture that may include embodiments of the disclosure herein. Throughout the disclosure, the terms "about" and "approximately" refer to a range of values ±5% of the numeric value that the term precedes.

The present disclosure is directed to a putter-type golf club head having a face insert that includes a striking front plate, a core comprising a plurality of channels, and a rear plate comprising a plurality of slots arranged along rear plate and in communication with the plurality of channels. The face insert may be additively manufactured as a unitary component, such that the core and the face insert are integrally formed. The face insert of the present disclosure overcomes complications associated with off-center mishits associated with the putter-type golf clubs. Typically, when a golf ball is struck by a putter, the golf ball launches off the face without rotating before it begins to skid or the golf ball skids a distance until a forward roll or a "true roll" starts. The true roll impacts the distance and control of the golf ball. Furthermore, when the golf ball is struck in a heel or a toe of a putter face, the golf ball diverges away from the intended line caused by the sidespin imparted by an off-center impact location. As the golf ball impacts the face insert off-center, an open-twist action or a closed twist action of the putter often induces the golf ball to diverge away from its intended path and imparts diverging spin to the golf ball. The core of the present disclosure is provided across the heel-to-toe of the face insert of the putter-type golf club head to account for the off-center impact of the golf ball. Further, the core is provided to impart a corrective cut spin in the heel and a corrective draw spin in the toe by converting a portion of the topspin. In this way, the face insert and core enhance the accuracy of the golf ball when hit with the putter-type golf club head of the present disclosure.

As described in detail below, the core may be provided in a variety of configurations and may take alternative forms than as shown and described hereinafter below. In general, the core enhances various performance characteristics of a putter-type golf club head that include the face insert as described herein, which may be modified to achieve distance variability, launch condition, aesthetic appearance, or spin control, among other characteristics. The putter-type golf club head disclosed herein may be manufactured through one or more of a variety of manufacturing processes or techniques. Persons skilled in the art will appreciate that the geometry of the core described herein may be manufactured by use of various techniques, including conventional manufacturing methods, such as, e.g., injection molding, extrusion, rotational molding, thermoforming, casting, forging, and milling, among other methods, or additive manufacturing, such as, e.g., binder jetting, material jetting, material extrusion, powder bed fusion, sheet lamination, directed energy deposition (DED), electron beam melting (EBM), direct metal laser sintering (DMLS), selective heat sintering (SHS), and selected laser melting (SLM), among other methods. It will be appreciated that the type of manufacturing technique used may be determined, at least in part, by the geometry and material of the core of the face insert. In some embodiments, the putter-type golf club head disclosed herein may be manufactured using a photopolymerization 3D printer that use UV sources, such as stereolithography (SLA), direct light processing (DLP), or digital light synthesis (DLS), to create photopolymer parts.

Additive manufacturing allows for complex geometries to be created, such as geometries of or within the face insert. For example, the face insert can include a core structure integrally formed therein and manufactured as a unitary component through additive manufacturing methods or processes employing additive manufacturing systems or machines. In some examples, the additive manufacturing systems and methods include a 3D printer. The face insert can include a lattice structure comprising a plurality of channels that extend in a heel-to-toe direction along an arched pattern or path that is convexly curved relative to a ground plane GP so that the arched pattern or path appears to be concave down to an observer when the golf club is oriented in an address position. The face insert may include a transparent or translucent materials or members, such that the core is visible from an exterior. The face insert with the core may have a geometry that induces different spin velocities and angles depending on where the face insert impacts the golf ball. In some examples, top spin may be induced when the impact location is in the center of the face insert, a hook corrective spin may be induced when the impact location is in the toe, and a cut corrective spin may be induced when the impact location is in the heel, or combinations thereof. Accordingly, the face insert as described herein can counteract off-center impact with the golf ball, e.g., when the impact location is laterally heelward or toeward of a centerline of the face insert. By imparting corrective spin, golfers using the face insert and putter disclosed herein have more control over the accuracy and trajectory of the golf ball, which can assist with preventing the golf ball from diverging from its intended target. Further, the face insert may comprise the core arranged or extending at various arcs or angles to customize the amount of cut spin or draw spin induced on the golf ball upon impact.

FIG. 1 depicts a golf club head 100, specifically a putter type golf club head, having a body 108 and a face insert 112 within an insert cavity or face cavity 116. The body 108 comprises a toe side 120, a heel side 124, a front side 128, a top side 132, a bottom side 136, and a rear side 140. Further, the body 108 includes a top portion or crown 160 on the top side 132 and a bottom portion or sole 164 on the bottom side 136 opposite the crown 160. The sole 164 of the golf club head 100 is configured to be parallel with and tangent to a ground plane GP when the golf club head 100 is at address. In the illustrated embodiment, the golf club head 100 also includes a shaft 144 connected to the top side 132 proximate the heel side 124 and extending upwardly away from the body 108. In some embodiments, the face insert 112 is coupled to the body 108 within the face cavity 116 on the front side 128 of the body 108. The face insert 112 may be coupled to the body 108 by an adhesive, or by jet welding around a peripheral interface inside the face cavity 116. The body 108 of the golf club head 100 may be formed from various metallic and/or non-metallic materials. For example, the body 108 may be formed from any one of or an alloy of aluminum, bronze, brass, copper, stainless steel, carbon steel, titanium, zinc, polymeric materials, and/or other suitable materials. In the illustrated embodiment, the face cavity 116 is formed as a recess on the front side 128 of the body 108, although other configurations are possible.

The face insert 112 comprises a plurality of grooves 168 extending laterally across a strike face 170 of the face insert 112 and spaced vertically from one another. For purposes of clarity, a vertical direction VD, as used herein, extends from the top side 132 to the bottom side 136, e.g., downward, or from the bottom side 136 to the top side 132, e.g., upward. Further, a lateral direction LAD, as used herein, extends perpendicular to the vertical direction VD and from the heel side 124 to the toe side 120, e.g., toeward, or from the toe side 120 to the heel side 124, e.g., heelward. Further, a longitudinal direction LOD is defined as extending perpendicular to the lateral direction LAD and the vertical direction VD and from the front side 128 to the rear side 140, e.g., rearward, or from the rear side 140 to the front side 128, e.g., forward.

Still referring to FIG. 1, the golf club head 100 comprises a toe region 148, a medial region 152, and a heel region 156. In the illustrated embodiment, the medial region 152 extends between a toe-side plane P1 at the toe region 148 and a heel-side plane P2 at the heel region 156. It will be appreciated that the toe side 120 is positioned within the toe region 148 of the body 108 and the heel side 124 is positioned within the heel region 156 of the body 108. In the illustrated embodiment, the face cavity 116 extends across the golf club head 100 from the toe region 148 to the heel region 156 and through the medial region 152. That is, the face cavity 116 is disposed within the toe region 148, the medial region 152, and the heel region 156. In some embodiments, the face cavity 116 is disposed within one of the toe region 148, the heel region 156, or the medial region 152. For example, the face cavity 116 may be formed only in the medial region 152. In some embodiments, the face cavity 116 extends continuously from the heel region 156 to the toe region 148 and through the medial region 152. In some embodiments, the face cavity 116 is interrupted or discontinuous within one of the heel region 156, medial region 152, or toe region 148.

Further, the face insert 112 is configured to conform to the shape of the face cavity 116. To that end, the face insert 112 extends within the face cavity 116 across the golf club head 100 from the toe region 148 to the heel region 156 and through the medial region 152. That is, the face insert 112 is disposed within the toe region 148, the medial region 152, and the heel region 156. In some embodiments, the face insert 112 is disposed within one of the toe region 148, the heel region 156, or the medial region 152. For example, the face insert 112 may be disposed only in the medial region 152. In some embodiments, the face insert 112 extends continuously from the heel region 156 to the toe region 148 and through the medial region 152. In some embodiments, the face cavity 116 is interrupted or discontinuous within one of the heel region 156, medial region 152, or toe region 148. In some embodiments, the face insert 112 extends partially within the face cavity 116, such that the face insert 112 is disposed within fewer of the toe region 148, the medial region 152, or the heel regions 156 than the face cavity 116. In some embodiments, the face insert 112 occupies greater than 70% of a volume defined by the face cavity 116.

In some embodiments, the body 108 can include a shaft mounting aperture (not shown) formed on the top side 132 within the heel side 124 to receive the shaft 144. In some embodiments, the body 108 includes a hosel (not shown) located within the heel side 124 and extending substantially vertically, e.g., in the sole-crown direction, from the top side 132. In some embodiments, the shaft 144, the aperture (not shown), and/or the hosel (not shown) may be located elsewhere on the golf club head 100, such as, e.g., within the medial region 152 approximately centrally between the toe side 120 and the heel side 124. Generally speaking the connection between the shaft 144 and the body 108 forms a neck, which may or may not include a hosel. The golf club head 100 may be configured for a variety of neck configurations, such as, e.g., a plumbers neck, flow neck, a slant neck, a long or extended hosel, a single-bend shaft, a double-bend shaft, or a straight shaft, among others.

Figure 2:
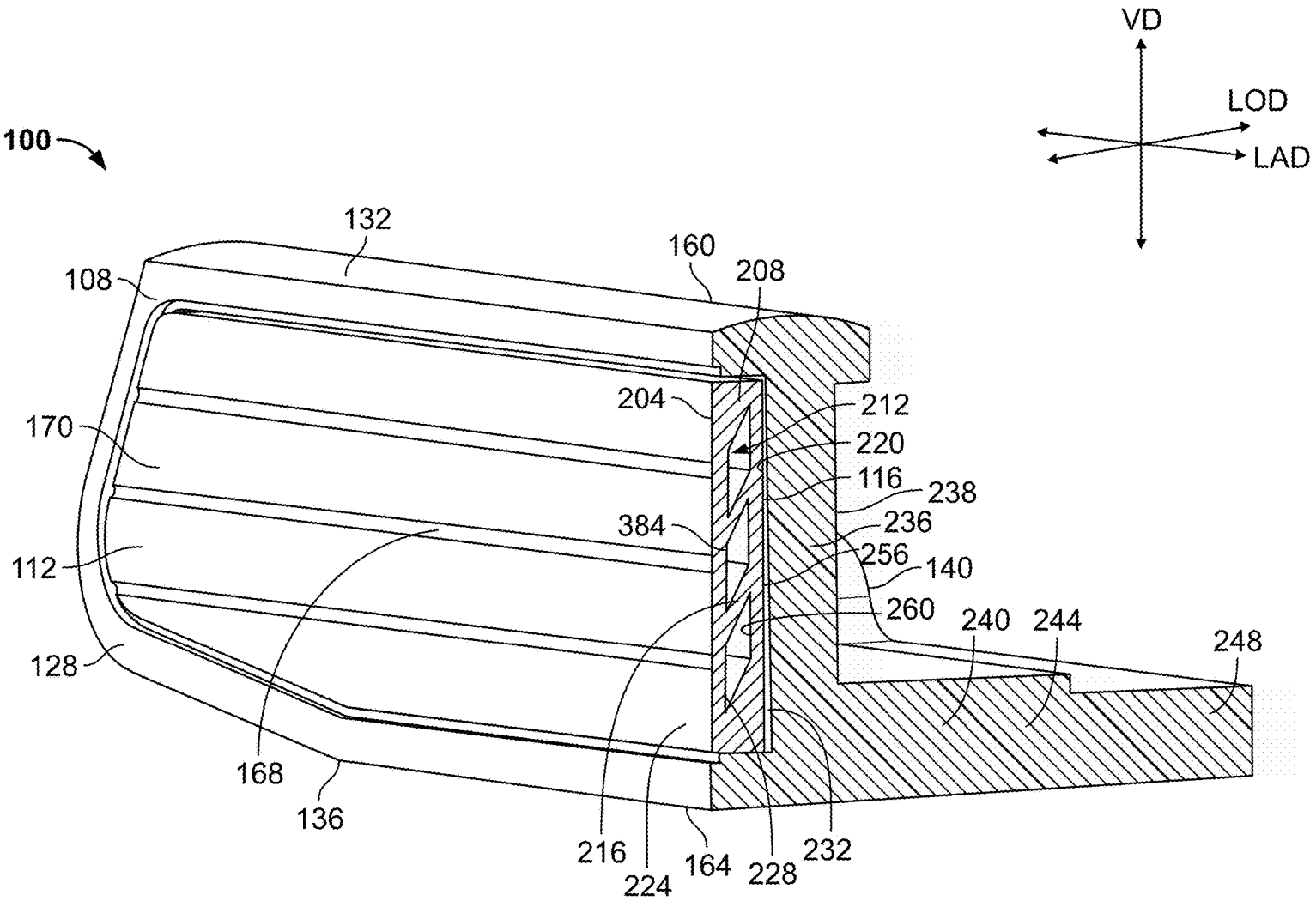
FIG. 2 is an isometric, cross-sectional view of the golf club head of FIG. 1 taken along the line 2-2.

Referring to FIG. 2, the face insert 112 includes a striking front plate or a front wall 204 and a core 208 connected to the front wall 204. In the illustrated embodiment, the core 208 includes a plurality of channels 212 and a plurality of ribs 216 arranged in an array across and/or along the face insert 112. Further, the face insert 112 includes a rear plate or rear wall 220 opposite the front wall 204. Accordingly, the core 208 is formed between and along the front wall 204 and the rear wall 220. Further, the core 208 is at least partially defined by the front wall 204 and the rear wall 220. In some embodiments, the core 208 extends partially within the front wall 204 or the rear wall 220, or both. In some embodiments, the core 208 is integrally formed within the face insert 112, such that the core 208 is integrally formed with the front wall 204 and the rear wall 220. In some embodiments, the core 208 is formed separately from the face insert 112 and coupled or attached between the front wall 204 and the rear wall 220. Further, the rear wall 220 and/or the front wall 204 may be formed separately from one another and attached as part of the manufacturing process to form the face insert 112. In some embodiments, the core 208 is disposed entirely within and internally of the face insert 112. In some embodiments, the core 208 may extend rearward of the rear wall 220 or forward of the front wall 204, such that the core 208 is disposed internally and externally of the face insert 112. As illustrated in FIG. 2, the front wall 204 of the face insert 112 includes an outer surface 224 that is opposite an inner surface 228, and the outer surface 224 includes the plurality of grooves 168 thereon. The plurality of grooves 168 are recessed into the outer surface 224 of the front wall 204 but the grooves 168 are separated from the core 208. The outer surface 224 provides the strike face of the face insert 112 that impacts the golf ball.

Further, the rear wall 220 includes an outer surface 256 that is opposite an inner surface 260, and the outer surface 256 is configured to face rearwardly toward the body 108 within the face cavity 116. Accordingly, the rear wall 220 is positioned farther rearwardly in the face cavity 116 than the front wall 204 of the face insert 112, and the outer surface 256 of the rear wall 220 is configured to face and abut a cavity seat 232 of the body 108 that at least partially defines the face cavity 116. The face insert 112 may be attached to the body 108 using a variety of techniques, such as, e.g., an adhesive layer applied to the rear wall 220 of the face insert 112 or the cavity seat 232 of the face cavity 116, or both, to adhesively attach the face insert 112 to the cavity seat 232. In some embodiments, the adhesive is a glue, a cement, a tape, or any compound or device for adhesively coupling the face insert 112 to the body 108. In some embodiments, the face insert 112 is attached to the body 108 by welding or fusing techniques.

In the illustrated embodiment, the body 108 includes a support member 236 extending vertically from the top side 132 to the bottom side 136. The support member 236 includes the cavity seat 232, which is an inner surface, and an outer surface 238 that is opposite the cavity seat 232. The outer surface 238 of the support member 236 of the body 108 is exposed on the rear side 140 of the body 108. A flange 240 extends rearwardly from the support member 236 near the bottom side 136, and the flange 240 includes a proximal portion 244 near the support member 236 and a distal portion 248 extending rearwardly from the proximal portion 244. The proximal portion 244 of the flange 240 defines a first thickness in the vertical direction VD and the distal portion 248 of the flange 240 defines a second thickness in the vertical direction VD. The first thickness of the proximal portion 244 is greater, e.g., thicker, than the second thickness of the distal portion 248 of the flange 240. That is, the flange 240 decreases in thickness moving in a direction away from the support member 236 or rearwardly. The crown 160 of the body 108 is connected to the support member 236 on the top side 132 of the body 108. In the illustrated embodiment, the crown 160 extends both forwardly and rearwardly from the support member 236, such that the crown 160 overhangs the support member 236 in at least one direction. Further, the sole 164 of the body 108 is defined at least partially by the flange 240. The sole 164 is formed on the bottom side 136 by the support member 236 and the flange 240. Accordingly, the sole 164 extends from the front side 128 of the body 108 to the rear side 140 of the body 108, and from the face cavity 116 to the distal portion 248 of the flange 240.

Figure 3:
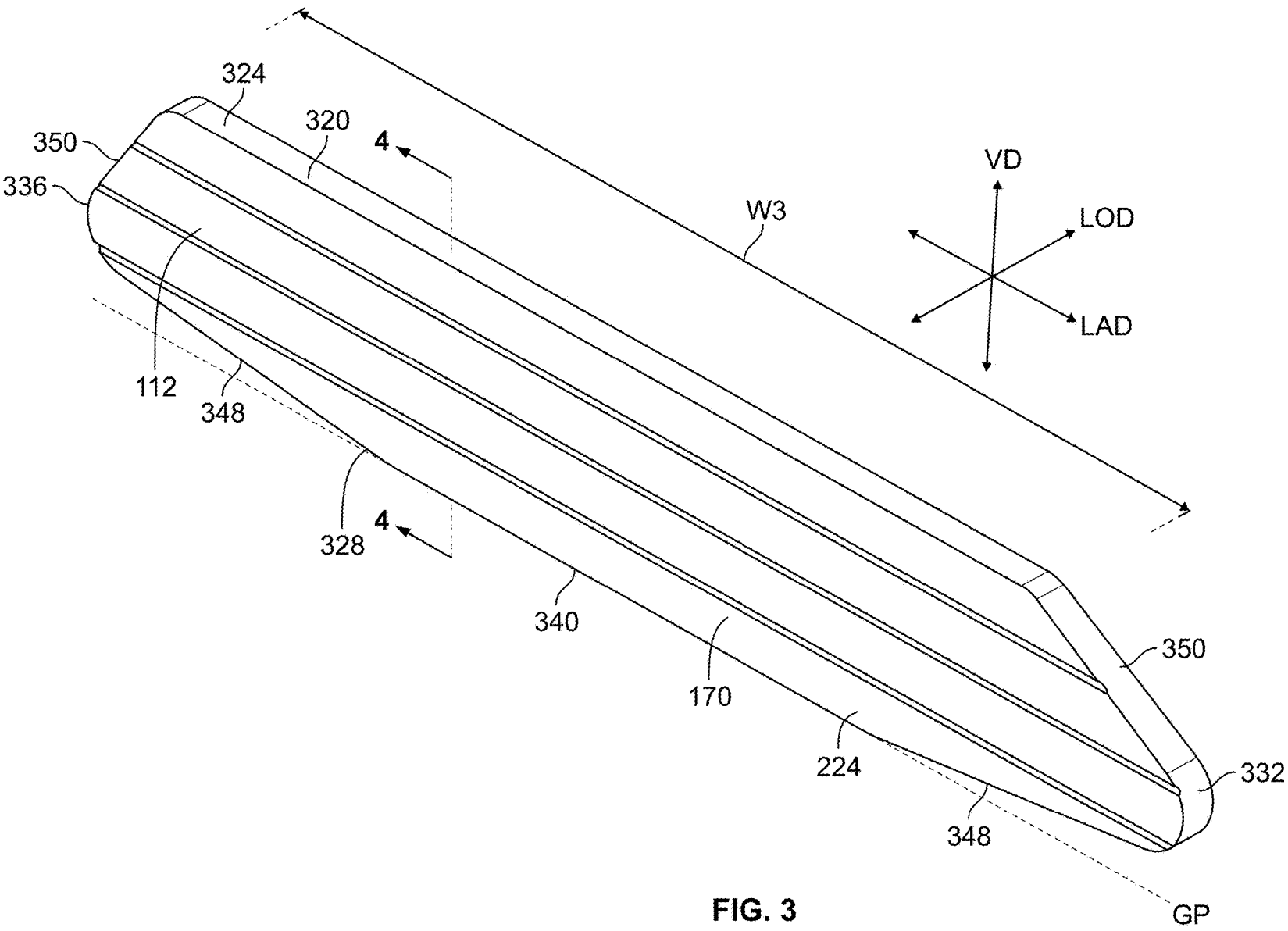
FIG. 3 is a front, top, right isometric view of the face insert of FIG. 1.

Referring to FIG. 3, the face insert 112 includes a periphery 320 that is formed between the front wall 204 and the rear wall 220. The periphery 320 includes an upper edge 324, a lower edge 328, a heel edge 332, and a toe edge 336. In the illustrated embodiment, the upper edge 324 extends linearly between the heel edge 332 and the toe edge 336, although other configurations are possible. Further, the heel edge 332 and the toe edge 336 are curved between the upper edge 324 and the lower edge 328. The lower edge 328 includes a mid-segment 340 that is generally parallel with the upper edge 324 and with the ground plane GP when at the golf club head is at address. The lower edge 328 further includes lower slanted segments 348 extending from the mid-segment 340 to the heel edge 332 and the toe edge 336, respectively, and extending at an angle relative to the ground plane GP. In the illustrated embodiment, the lower slanted segments 348 extend away from the mid-segment 340 and upwardly away from the ground plane GP toward the respective heel edge 332 and toe edge 336, although other configurations are possible. Further, upper slanted segments 350 extend downwardly from the upper edge 324 toward the respective heel edge 332 and toe edge 336. The face insert 112 extends in the lateral direction LAD or heel-to-toe direction to define a width W3. The width W3 may be defined along the heel-to-toe direction LAD for the plurality of channels 212. In the illustrated embodiment, at least one rib 216 defines a dimension, e.g., a width, that is different from a corresponding dimension, a width, of at least one other rib 216. Similarly, at least one channel 212 defines a dimension, e.g., a width, that is different from a corresponding dimension, a width, of at least one other channel 212.

Referring back to FIG. 2, the plurality of channels 212 are spaced vertically from one another between the upper edge 324 and the lower edge 328. The plurality of channels 212 extend laterally, e.g., in the heel-toe direction LAD (see FIG. 3), along the face insert 112 between the heel edge 332 and the toe edge 336. Accordingly, the core 208 comprising the plurality of channels 212 and the plurality of ribs 216 is surrounded by and spaced inwardly from the periphery 320 of the face insert 112. The plurality of ribs 216 extend at an angle between the front wall 204 and the rear wall 220, e.g., at least one of the upper or lower surfaces of at least one of the ribs is angled between the front and rear walls, and may comprise a lattice structure embedded within the plurality of ribs 216. In the illustrated embodiment, the plurality of ribs 216 of the core 208 are disposed entirely rearwardly of the front wall 204 and entirely forwardly of the rear wall 220, although other configurations are possible. In the illustrated embodiment, the plurality of ribs 216 extend rearwardly and upwardly, e.g., inclined, relative to the front wall 204. In some embodiments, the plurality of ribs 216 may extend rearwardly and downwardly, e.g., declined, from the front wall 204, or the plurality of ribs 216 may extend rearwardly and orthogonally, e.g., forming a right angle, from the front wall 204. Additionally or alternatively, the plurality of ribs 216 may extend heelward or toeward from the front wall 204 to the rear wall 220. The plurality of ribs 216 may each have a uniform thickness and the plurality of channels 212 may each have an identical cross-sectional profile 384. In some embodiments, the plurality of ribs 216 may taper or narrow in thickness in one or more directions, e.g., vertically or laterally or longitudinally or some combination thereof, between the front wall 204 and the rear wall 220. Accordingly, the plurality of ribs 216 are configured to provide the core 208 of the face insert 112 with variable stiffness and reinforcement properties for improved control and accuracy during impact with a golf ball.

It is contemplated that at least some of the plurality of ribs 216 may be cantilevered between the front wall 204 and the rear wall 220, such that one or more ribs 216 contact the front wall 204 and not the rear wall 220, or one or more ribs 216 contact the rear wall 220 and not the front wall 204. It is further contemplated that the plurality of ribs 216 may be at least partially hollow, such that an interior volume or gap is formed separately from the plurality of channels 212. In the illustrated embodiment, each of the channels 212 has a cross-sectional profile 384 in the shape of a parallelogram, although other configurations are possible. In some embodiments, the plurality of channels 212 have a cross-sectional profile 384 in the shape of a rectangle, a triangle, a square, a circle, a rhombus, an octagon, or any other suitable shape. In some embodiments, the cross-sectional profile 384 of each channel may be different from one another, such that one cross-sectional profile 384 of a channel has a rectangular shape, another cross section 384 has a square shape, and yet another cross section 384 has a triangular shape. Further, the plurality of ribs 216 may extend from the front wall 204 to the rear wall 220 to form a cambered, sinusoidal, parabolic, or other curvilinear cross-sectional profile 384.

Figure 4:
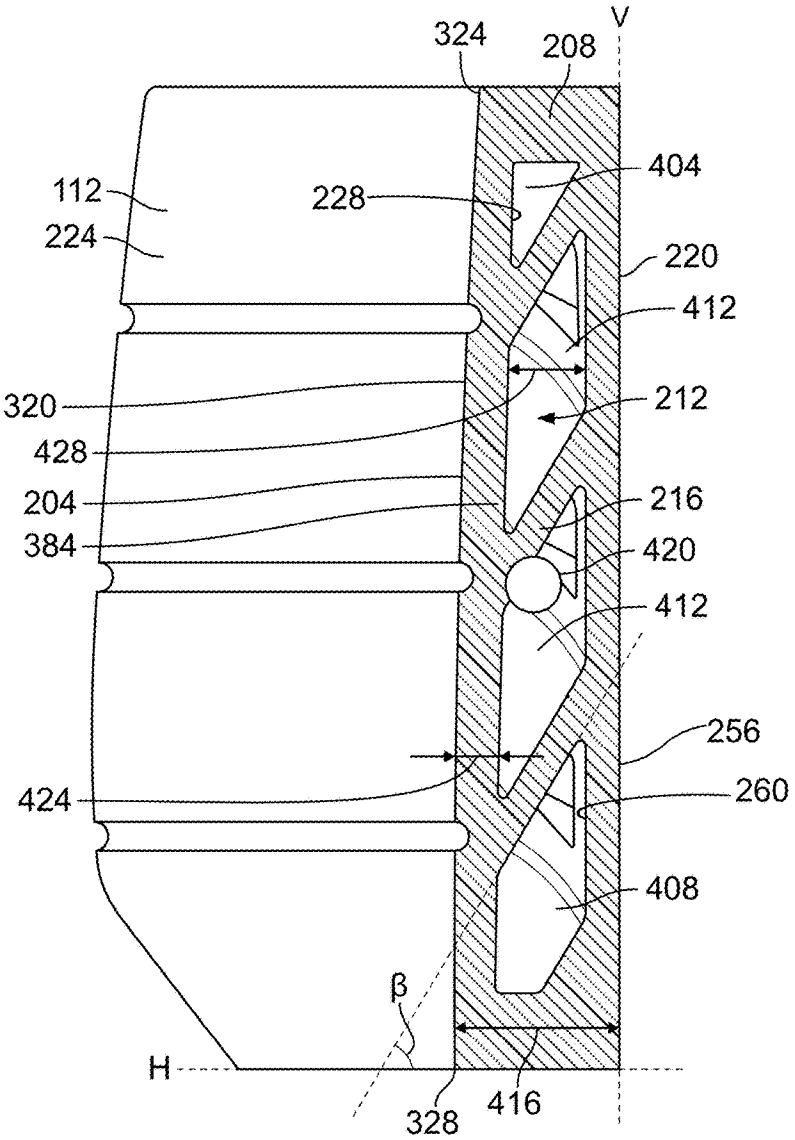
FIG. 4 is a partial, cross-sectional view of a front and right side the face insert of FIG. 3 taken along the line 4-4.

Referring to FIG. 4, the plurality of channels 212 comprises an uppermost channel 404 and a lowermost channel 408, and at least one intermediate channel 412 is disposed between the uppermost channel 404 and the lowermost channel 408. In some embodiments, the plurality of channels 212 may comprises at least three channels. In some embodiments, the plurality of channels 212 comprises four channels, five channels, six channels, seven channels, eight channel, nine channels, ten channels, or more. The cross-sectional profile 384 of the uppermost channel 404, the intermediate channels 412, and the lowermost channel 408 may be shaped as a square, a rectangle, a circle, a triangle, a pentagon, a hexagon, an octagon, a parallelogram, a polygon, or any other suitable shape. As described hereinafter below, the face insert 112 assembly may comprise polymeric material and may be manufactured using 3D printing techniques and systems. In some embodiments, the face insert 112 may be manufactured using another known technique of manufacturing. It is further contemplated that in some embodiments, the face insert 112 may comprise metallic materials, e.g., steel, or non-metallic materials such as, e.g., polycarbonate or ceramics, and/or may be manufactured using 3D printing techniques and systems. In some embodiments, the face insert 112 may be formed of a composite material having a Shore A Hardness of between about 80 A and about 95 A. In some embodiments, the body 108 is formed of a metallic material, such as steel, such that the face insert 112 and the body 108 are made of different materials.

Referring to FIG. 4, the cross-sectional view is taken along the line 4-4 of the front wall 204, and the core 208 comprising the plurality of channels 212 and the plurality of ribs 216 is shown. In the illustrated embodiment, the plurality of ribs 216 are depicted as extending at an inclined angle β relative to a horizontal axis H that is parallel with the ground plane GP (see FIG. 1). Further, a vertical axis V extends orthogonally relative to both the ground plane GP and the horizontal axis H, as illustrated in FIG. 4. The inclined angle β of the plurality of ribs 216 may vary among the plurality of ribs 216, or each rib of the plurality of ribs 216 may extend at the same, identical inclined angle β. As a result of the inclined angle β, the plurality of ribs 216 of the core 208 of the face insert 112 experience compressive and shear forces at impact with a golf ball, and varying the inclined angle β, thickness, size, arrangement, and material of the plurality of ribs 216 of the core 208 provides for different responses to such shear and compressive forces. In some embodiments, the incline angle β of the plurality of ribs 216 may be between about 10 degrees and about 90 degrees, or between about 20 degrees and about 80 degrees, or between about 40 degrees and about 60 degrees. In some embodiments, the plurality of ribs 216 extend rearwardly and downwardly from the front wall 204 to the rear wall 220 and, thus, the incline angle ß is negative, i.e., a decline angle, relative to the horizontal plane H. In some embodiments, the decline angle is between about −10 degrees and about −90 degrees, or between about −20 degrees and about −80 degrees, or between about −40 degrees and about −60 degrees. Accordingly, the plurality of ribs 216 of the core 208 are arranged to provide corrective force vector profiles along the face insert 112, as will be discussed below.

A face insert thickness 416 is defined between the front wall 204 of the face insert 112 and the rear wall 220 of the face insert 112. In particular, the face insert thickness 416 is defined between the outer surface 224 of the front wall 204 and the outer surface 256 of the rear wall 220. Further, the face insert thickness 416 may vary between the upper edge 324 and the lower edge 328 of the face insert 112. In some embodiments, the thickness 416 of the insert 112 along the lower edge 328 gradually reduces moving in the upward direction toward the upper edge 324, such that the maximum overall thickness 416 of the face insert is measured at the lower edge 328 and the minimum is measured at the upper edge 324, although other configurations are possible. A thickness 424 of the striking front plate is defined between the outer surface 224 and the inner surface 228 of the front wall 204, as illustrated in FIG. 4, and the front wall 204 is thicker along the periphery 320 of the front wall 204 of the face insert 112 and gradually thins toward the geometric center 420. The plurality of channels 212 within the core 208 may reduce the thickness 416 of the face insert 112 at different locations. The plurality of channels 212 may have a different cross-sectional profile 384 and the different cross-sectional profiles may vary the overall thickness 416 of the face insert 112. As illustrated in FIG. 4, the core 208 is positioned between the front wall 204 and the rear wall 220, such that the core 208 extends between the inner surface 228 of the front wall 204 and the inner surface 260 of the rear wall 220. Accordingly, a thickness 428 of the plurality of channels 212 is defined between inner surface 228 of the front wall 204 and the inner surface 260 of the rear wall 220, such that the thickness 428 is the maximum front-to-back distance in the front-back direction perpendicular to at least one of the inner surface 228 of the front wall 204 and the inner surface 260 of the rear wall 220. The thickness 428 of the plurality of channels 212 may be between about 10% and about 60% of the overall thickness 416 of the face insert 112. The thickness 424 between the front wall 204 and the cross-sectional profile 384 may be between about 10% and 20% of the overall thickness 416 of the face insert 112. The current configuration of the face insert 112 comprising thicker upper edge 324 and lower edge 328 and thinner front wall 204 may provide a trampoline effect allowing the face insert 112 to provide increased shot distance, which is particularly beneficial for iron-type golf club heads and wood-type golf club heads.

Still referring to FIG. 4, the cross-sectional profile 384 of the plurality of channels 212 within the core 208 of the face insert 112 is shown. The plurality of channels 212 extends from the heel region 156 across the medial region 152 toward the toe region 148. In some embodiments, the front wall 204 and the rear wall 220 may be opaque, and the core 208 and the plurality of channels 212 are concealed between the front wall 204 and the rear wall 220. Alternatively, the front wall 204 and/or rear wall 220 may be translucent or semitransparent, such that the core 208 may be at least partially visible through the front wall 204 and/or the rear wall 220 from an exterior of the face insert 112. In the present implementations, ASTM standard D1003 20221 Edition (Standard Test Method for Haze and Luminous Transmittance of Transparent Plastics) may be used to measure the visible light transmissivity and, thus, relative transparency/translucency/opaqueness of the herein-described materials. Further, it is intended that the suggested testing protocols be followed for the particular material being reviewed and that if Procedure A, which utilizes a hazemeter, or Procedure B, which used a spectrophotometer, provide for different visible light transmission results/percentages, that the higher value of the two procedures be used for purposes of the present disclosure. It is also contemplated that if a subject material to be considered for purposes of this disclosure has a non-planar configuration, e.g., a groove, that a planar portion of the particular material be used for testing purposes.

Alternatively, ASTM standard D1746 2021 Edition (Standard Test Method for Transparency of Plastic Sheeting) may be used to measure opacity and, thus, the relative transparency/translucency/opaqueness of the herein-described materials, with suitable standardized equipment, such as an opacity meter. As used herein, the term "opacity" refers to the extent to which a surface, an object, or a layer of material impedes the transmission of light through it and, thus, is the inverse of the visible light transmissivity measurement referenced herein. It is contemplated that opacity and visible light transmissivity may be used interchangeably and that measurements according to either ASTM D1003 or ASTM D1746 may be used; however, for purposes of this disclosure, the measurements of visible light transmissivity according to ASTM D1003 protocols are preferred.

It is contemplated that the golf club head 100 includes an alignment aid (not shown) for assisting a golfer with alignment of the golf club head 100 with a golf ball at impact. In some instances, the alignment aid may include a light collector (not shown) provided in the form of an aperture disposed on the top side 132 in the crown 160 or on the rear side 140 in the support member 236 for collecting ambient light, passing the collected light through the golf club head 100, amplifying the collected ambient light with a reflective surface or device, and projecting the collected and amplified light through a passage or lens formed in the face insert 112 that is, in some instances, comprised of a translucent or transparent material. The reflective surface or device may comprise a highly reflective material, e.g., silver, aluminum, or any a material or surface or composite material having a light reflectance value (LRV) of at least 70% measured in accordance with ASTM E903 or equivalents.

Figure 5:
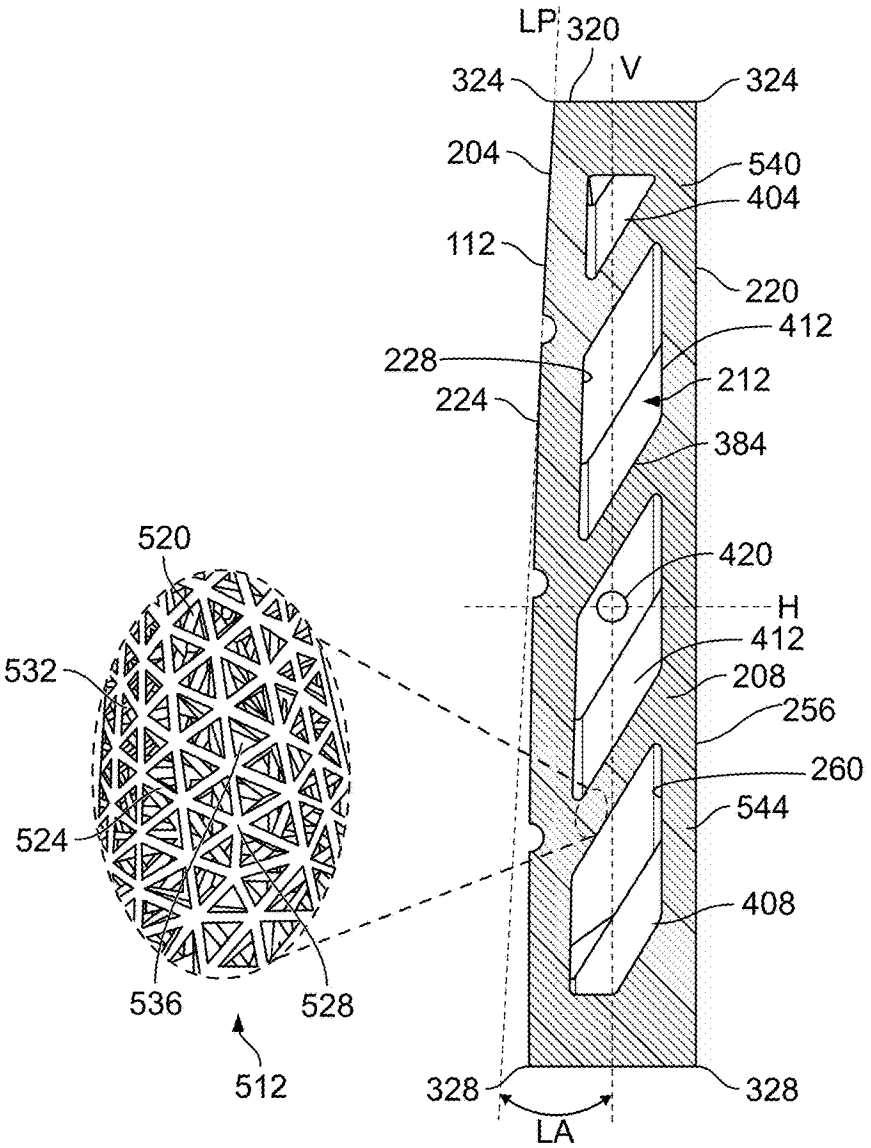
FIG. 5 is a cross-sectional view of a right side the face insert of FIG. 3 taken along the line 4-4, with an enlarged area to illustrate a geometry of the face insert.

Referring to FIG. 5, the cross-sectional view of the face insert 112 comprises a polygonal lattice mesh topology 512 or a lattice structure that is defined within the core 208 formed during the manufacturing process. The lattice structure 512 is formed within the core 208 of the face insert 112 between the front wall 204 and the rear wall 220. The terms "segmented structure," "lattice structure," or "meshed structure" are used herein to refer to portions of a golf club head that are formed by one of a plurality of interconnected segments 524, interconnected shapes 520, or connected surfaces. In some embodiments, the plurality of interconnected segments 524, interconnected shapes 520, or connected surfaces may be formed integrally with a golf club head 100. In some embodiments, the lattice structure 512 may define at least one cutout, or absence of material, that is formed within a unit cell, e.g., a repeated pattern defined by the lattice structure 512. The lattice structure 512 may be centered around a node 528. The use of lattice structure 512 within a golf club head 100 substantially reduces the weight and/or the density of the golf club head 100.

Still referring to FIG. 5, the lattice structure 512 within the cross section of the face insert 112 may extend laterally in the heel-to-toe direction along the plurality of channels 212. The size of the lattice structure 512 may vary based on the location of the lattice structure 512. The size of the lattice structure refers to the length of the interconnected segments 524 and/or the spacing between the nodes 528. The size of the lattice structure 512 may describe how compact the lattice structure 512 is formed. The compactness of the lattice structure 512 describes the density of the lattice structure 512. The density of the lattice structure 512 provides different properties. The high-density lattice structure 532 may be stronger due to more segments being reinforced in the area making the area more durable and rigid. Conversely, low-density lattice structure 536 may compromise rigidity and durability to provide the benefits of light weight and increased flexibility. The high-density lattice structure 532 may be interconnected with low-density lattice structures 536 depending on the region of the face insert 112. The high-density lattice structure 532 may be oriented along the periphery 320 to provide more support and rigidity, while the low-density lattice structure 536 may be located toward the geometric center 420 to provide flexibility and reduced weight. In some embodiments, the size of the lattice structure 512 may vary with respect to the thickness of the interconnected segments 524 in response to conditions of the face insert 112. In some embodiments, the lattice structure 512 may vary directionally along the face insert 112 in a vertical direction from the lower edge 328 to the upper edge 324. In some embodiments, the lattice structure 512 may vary in a lateral direction from the heel side 124 of the face insert 112 to the toe side 120 of the face insert 112. In some embodiments, the lattice structure 512 may vary directionally from the periphery 320 of the face insert 112 to the geometric center 420 of the face insert 112. For example, as depicted in FIG. 5, the orientation has high-density lattice structure 532 along the perimeter and the cross-sectional profiles 384 of the plurality of channels 212 and the lattice structure 512 is less dense between the periphery 320 and the cross-sectional profile 384 of the plurality of channels 212. In some embodiments, the upper edge 324, the lower edge 328, and the periphery 320 of the golf club head 100 are solid. By making the upper edge 324, the lower edge 328, and the periphery 320 denser, the front wall 204 may provide improved sound qualities and uniformity in striking accuracy and shot distance during impact with the golf ball.

With reference to FIG. 5, the front wall 204 of the face insert 112 defines a loft axis LP that lies in a plane that is tangent to and parallel with a portion of the outer surface 224. A loft angle LA is defined by the loft axis LP relative to the vertical axis V that extends through the geometric center 420. In the illustrated embodiment, the loft angle LA tilts rearwardly toward the vertical axis V and the rear wall 220, although other configurations are possible. Further, the outer surface 224 of the front wall 204 may be convexly curved relative to the vertical axis V, such that the loft angle LA is different when measured along an upper portion 540 of the front wall 204 than when measured along a lower portion 544 front wall 204. In the illustrated embodiment, the upper portion 540 of the face insert 112 is disposed above the horizontal axis H that extends through the geometric center 420 and the lower portion 544 is disposed below the horizontal axis H, such that the horizontal axis H and geometric center 420 bifurcate the face insert 112 into the upper portion 540 and the lower portion 544. In some embodiments, the loft angle LA may be between about 1 degree and about 30 degrees relative to the vertical axis V.

Additive manufacturing or 3D printing is a process of making three dimensional solid objects from digital file. The creation of a 3D printed object is achieved using an additive process wherein an object is created by laying down successive layers of material until a part is created. The part is created using a computer aided drafting (CAD) software. After the part is designed using a CAD software, the part is further optimized through topology optimization, which is discussed below. The topology optimization provides optimal material distributions by forming different lattice structures within a given shape or a volume, which may be based on finite element analysis (FEA). The optimum stiffness-to-weight ratio may be determined by implementing different topology algorithms, such as, but not limited to Solid Isotropic Material with Penalization (SIMP) method, Bi-directional Evolutionary Structural Optimization (BESO) method, or by convolutional neural network (CNN). The optimized parts are then built using a 3D printer and the 3D printers comprises different printing methods such as, but not limited to fuse deposition method (FDM), stereolithography (SLA), digital light processing (DLP), selective laser sintering (SLS), selective laser melting (SLM), digital beam melting (EBM), or binder jetting.

As described herein, "a photopolymer", "a liquid photopolymer" or "a resin" may be used interchangeably to describe the polymeric material inside a vat or a tank during a VAT polymerization 3D printing. The VAT polymerization is one such 3D printing technology that utilizes a bonding source, such as a light source, a UV source, a heat source, a laser beam, or the like to bond the material. The build platform of a VAT polymerization 3D printer is positioned inside a tank that is filled with liquid photopolymer. The height of the tank between the build platform and the tank is taller than the height of a fully printed 3D physical part. After the platform is correctly positioned, a ray of light or laser from the source is allowed to pass. This ray of light creates the part by layers selectively curing and solidifying the photopolymer resin. After solidifying a layer, the same process is repeated for the other layers as the build platform moves at a safer distance as soon as the solidifying of one layer is finished. The process is repeated until the part is fully printed. The solidification of liquid resin is often called photopolymerization. During this solidification process, monomer carbon chains are activated by a source of light and permanent bonds between the monomers are created.

Figure 6:
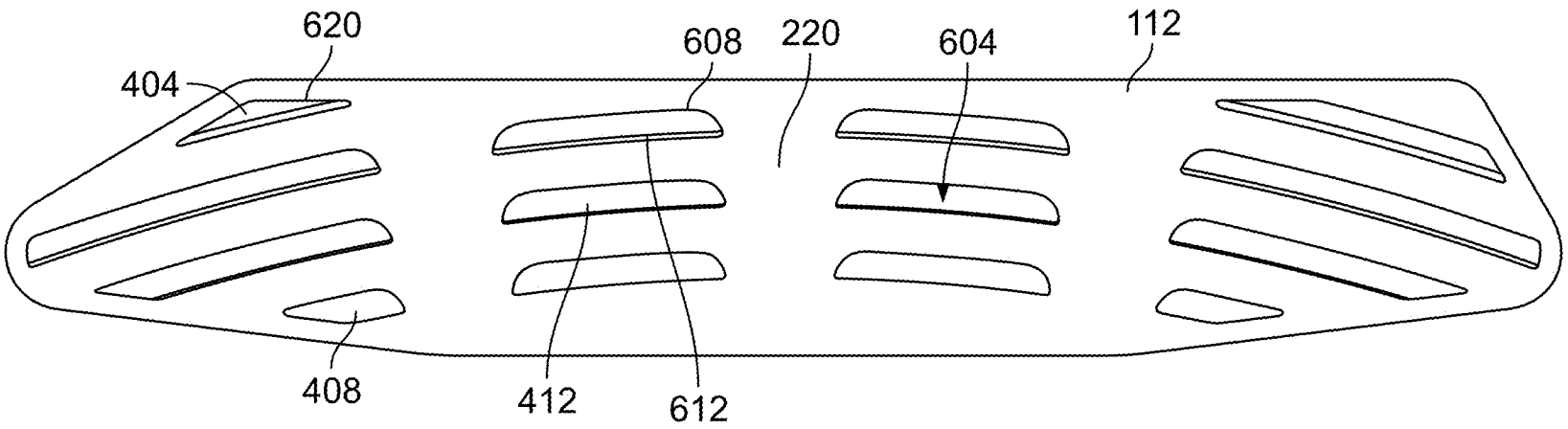
FIG. 6 is a rear view of the face insert of FIG. 3.

Referring to FIG. 6, a rear view of the face insert 112 comprising a plurality of slots 604 extending along the plurality of channels 212 is shown. In the illustrated embodiment, the rear wall 220 comprises the plurality of slots 604 arranged along the plurality of channels 212 to overlie the plurality of channels 212 in the longitudinal direction LOD, i.e., front-back direction. In some embodiments, plurality of slots 604 have generally oblong shapes that may vary based on the location along the face insert 112 and in proportion to the arrangement of the core 208, including in proportion to the plurality of channels 212. For example, the plurality of slots 604 may include triangular slots positioned along and in fluid communication with the uppermost channels 404 of the plurality of channels 212 and trapezoidal slots positioned along and in fluid communication with the intermediate channels 412 or lowermost channels 408 of the plurality of channels 212. Each slot of the plurality of slots 604 is defined by an outer periphery 612 that can include at least one rounded corner 608, such as a chamfer or fillet, and at least one pointed or acute corner 620.

The plurality of slots 604 by the rear wall 220 serve as one or more cavities for excess material to escape during the additive manufacturing process. In some embodiments, the printed 3D part may include a plurality of ribs 216 embedded with a lattice structure and a plurality of channels 212. For example, the removal of the excess resin by rinsing, washing, and curing allows the printed part to be highly functional, highly accurate, and provides a smooth surface finish. Residual resin inside of or on the face insert 112 may result in undesirable surface finish and may disrupt the benefits provided by the core 208. Further, the slots 604 being positioned at the rear wall 220 improves the sound of the golf club head 100 during the impact with the golf ball by, e.g., providing entrapping and muffling the sound waves between the face insert 112 and the body 108, thereby attenuating the sound produced from impact. Accordingly, the plurality of slots 604 are located along the rear wall 220 to allow resin to escape during the manufacturing process. As the face insert 112 is printed layer-by-layer, excess resin trapped within the face insert 112 can be removed by the application of compressed air or by washing the printed part in a curing agent. In this way, the plurality of slots 604 enable the removal of the trapped resin and provide a means of egress for excess material and resin produced during manufacturing, as well as providing access to the core 208 of the face insert 112 to assist with removal of excess materials and resin. In addition, the rounded corners 608 may assist with the flow of resin out of the plurality of channels 212 of the core 208 and can also provide improved sound performance for the face insert 112 at impact.

Figure 7:
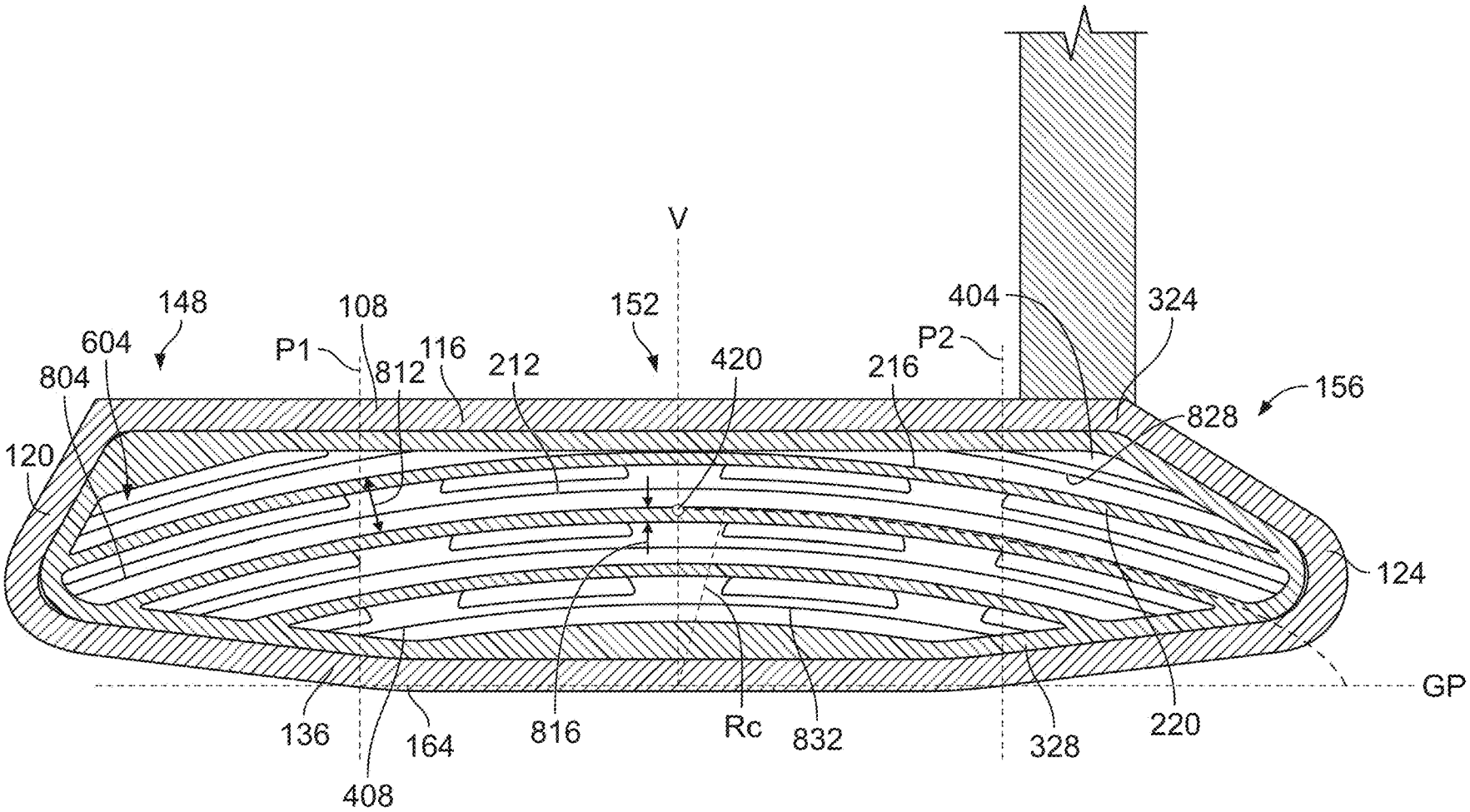
FIG. 7 is a cross-sectional view of a front of the golf club head of FIG. 1 taken along the line 7-7.

Referring to FIG. 7, the plurality of channels 212 and the plurality of ribs 216, which together comprise the core 208, arranged to form an arched pattern 804 or a sun-set arc pattern, is shown. The cross-sectional view illustrates the core 208 comprising the plurality of channels 212 and the plurality of ribs 216 extending in a heel-to-toe direction. As illustrated, the vertical axis V is disposed centrally of the putter-type golf club head 100 and face insert 112, such that the geometric center 420 of the face insert 112 is intersected by and coaxial with the vertical axis V. In some embodiments, the plurality of channels 212 may be arranged to form an arched pattern 804. To that end, the plurality of channels 212 are vertically spaced apart, i.e., in a direction parallel with the vertical axis V, from one another between the upper edge 324 and the lower edge 328 of the face insert 112. Similarly, the plurality of ribs 216 are vertically spaced apart from one another between the upper edge 324 and the lower edge 328 of the face insert 112. As illustrated, the core 208, which comprises the plurality of ribs 216 and the plurality of channels 212, extends downwardly within the heel region 156 and the toe region 148. That is, the core 208, which comprises the plurality of ribs 216 and the plurality of channels 212, curves downwardly and extends laterally away from the vertical axis V that intersects the geometric center 420, which forms the arched pattern 804. Accordingly, the arched pattern 804 of the core 208 extends concavely relative to the sole 164 and, thus, the ground plane GP.

In the illustrated embodiment, each rib 216 extends concavely relative to the sole 164 and, thus the ground plane GP, such that a radius of curvature Rc is defined as a distance between each rib 216 and a point that is formed at the intersection between the vertical axis V and the ground plane GP at the sole 164. As illustrated, the radius of curvature Rc may represent the radius of an ellipse or oval, which may include a semi-major component, i.e., the longest dimension, and a semi-minor component, i.e., the shortest dimension, as will be understood by those skilled in the art. Accordingly, the longest dimension or semi-major component of the radius of curvature Rc is formed where each rib 216 joins the periphery 320 and the shortest dimension or semi-minor component is formed where each rib 216 is intersected by the vertical axis V. As such, the radius of curvature Rc can be represented by a parabolic or polynomial equation as it increases between the shortest dimension or semi-minor component at the vertical axis V and the longest dimension or semi-major component at the opposing ends of the ribs 216.

With continued reference to FIG. 7, the radius of curvature Rc of each rib 216 may vary across the heel region 156, the medial region 152, or the toe region 148 to define the arched pattern 804 in the core 208. Accordingly, the arched pattern 804 of the core 208 comprises the radius of curvature Rc of each rib 2216 across the face insert 112 and, thus, the plurality of channels 212 disposed between the plurality of ribs 216 also extend along the arched pattern 804 defined by the radius of curvature Rc. In some embodiments, the radius of curvature Rc of the arched pattern 804 of the core 208 varies among the heel region 156, the medial region 152, and the toe region 148. For example, the radius of curvature Rc in the heel region 156 may differ from the radius of curvature Rc in the toe region 148, such that the arched pattern 804 of the core 208 is different in the heel region 156 and the toe region 148.

In some embodiments, the plurality of ribs 216 and the plurality of channels 212 of the core 208 may be arranged in a pattern corresponding to circular radius of curvature, or the core 208 may be arranged in a pattern that is sinusoidal, or stepwise, or triangular, or concentric, among other configurations. For instance, the plurality of ribs 216 and the plurality of channels 212 of the core 208 may comprise several inflection points along the face insert 112, with one inflection point being located in the heel region 156, another inflection point being located in the medial region 152, and still another inflection point being located in the toe region 148. In another instance, each of the toe region 148, the medial region 152, and the heel region 156 include a plurality of inflection points defined by the core 208.

Still referring to FIG. 7, the plurality of slots 604 may be positioned along the plurality of channels 212 following the arched pattern 804 along the rear wall 220. The plurality of slots 604 along the rear wall 220 are in fluid communication with the plurality of channels 212 formed within the core 208. In some embodiments, each slot 604 is in fluid communication with at least one of the plurality of channels 212. At least some of the plurality of channels 212 and the plurality of ribs 216 extend continuously laterally from the heel side 124 to the toe side 120 of the golf club head 100. The plurality of channels 212 are at least partially defined between the front wall 204 and the rear wall 220. Further, the plurality of channels 212 are at least partially defined by the plurality of ribs 216 extending from the heel region 156 to the toe region 148, such that each channel 212 is disposed between adjacent ribs 216 or between one rib 216 and the periphery 320. Further, each channel 212 has a height dimension, i.e., measured in the vertical direction and/or normal to the curvature relative to the sole 164, that is less than or equal to a distance 812, i.e., measured in the vertical direction and/or normal to the curvature relative to the sole 164, defined between adjacent ribs 216, such that the distance 812 corresponds to the height dimension of the plurality of ribs 216. The distance 812 may vary within the heel region 156, the medial region 152, and the toe region 148, or some combination thereof. The distance 812 may gradually increase moving inwardly from the periphery 320 toward the geometric center 420. The plurality of channels 212 define a channel volume within the face insert 112 among the front wall 204, the rear wall 220, the plurality of ribs 216, and the periphery 320. Accordingly, the face insert 112 defines a face insert volume, which accounts for the entire face insert 112 as bounded by the periphery 320, and the channel volume of the core 208 is less than the face insert volume. Thus, the channel volume can be expressed as a ratio or percentage of the face insert volume. In some embodiments, the channel volume is between about 5% and about 95% of the face insert volume, or between about 15% and about 85%, or between about 25% and about 75%, or between about 35% and about 65%, or between about 40% and about 60%. It will be appreciated that the distance 812 is proportional to the ratio of the channel volume to the face insert volume, such that when the distance 812 is greater, channel volume increases and, thus, the channel volume comprises a greater percentage of the face insert volume.

In some embodiments, the distance 812 is between about 1.5 mm and about 1.6 mm, or about 1.6 mm and about 1.7 mm or about 1.7 mm and about 1.8 mm, or about 1.8 mm and about 1.9 mm, or about 1.9 mm and about 2.0 mm, or about 2.0 mm and about 2.1 mm, or about 2.1 mm and about 2.2 mm, or about 2.2 mm and about 2.3 mm, or about 2.3 mm and about 2.4 mm, or about 2.4 mm and about 2.5 mm, or about 2.5 mm and about 2.6 mm. Increasing the distance 812 between the ribs 216 correlates to an increase in the percentage of void space defined by the core 208 in the face insert 112. For example, each rib 216 is about 0.7 mm in thickness 816 and the distance 812 between the ribs 216 is about 2.0 mm in FIG. 7. The plurality of ribs 216 and the plurality of channels 212 in the face insert 112 may vary in quantity from what is shown herein.

Still referring to FIG. 7, each rib 216 defines a thickness 816 in the vertical direction VD, when measured near the vertical axis V. The thickness 816 may remain constant or uniform as the rib 216 curves relative to the sole 164, or the thickness 816 may vary along the rib 216 as it extends away from the vertical axis V. In some embodiments the thickness 816 of each rib 216 is between about 0.7 mm and about 0.8 mm, or between about 0.8 mm and about 0.9 mm, or about 0.9 mm and about 1.0 mm, or about 1.0 mm to 1.1 mm, or about 1.1 mm and about 1.2 mm, or about 1.2 mm and about 1.3 mm, or about 1.3 mm and about 1.4 mm, or about 1.4 mm and about 1.5 mm, or about 1.5 mm and about 1.6 mm, or about 1.6 mm and 1.7 mm, or about 1.7 mm and about 1.8 mm, or about 1.8 mm and about 1.9 mm, or about 1.9 mm and about 2.0 mm. In some embodiments, the plurality of ribs 216 may each have uniform thickness 816. In some embodiments, the plurality of ribs 216 may vary in thickness 816 in relation to one another. It will be appreciated that increasing the thickness 816 of the plurality of ribs 216 correlates to decreasing the percentage of the channel volume relative to the face insert volume. Accordingly, within the face insert 112, the distance 812 between the ribs 216 is inversely proportional to the thickness 816. It will be appreciated that the printing resolution, material, printing orientation, tolerances of the additive manufacturing technology can influence the thickness 816. For example, a minimum value for the thickness 816 may be required to maintain the structural integrity of the face insert 112 at the impact with the golf ball.

Figure 8:
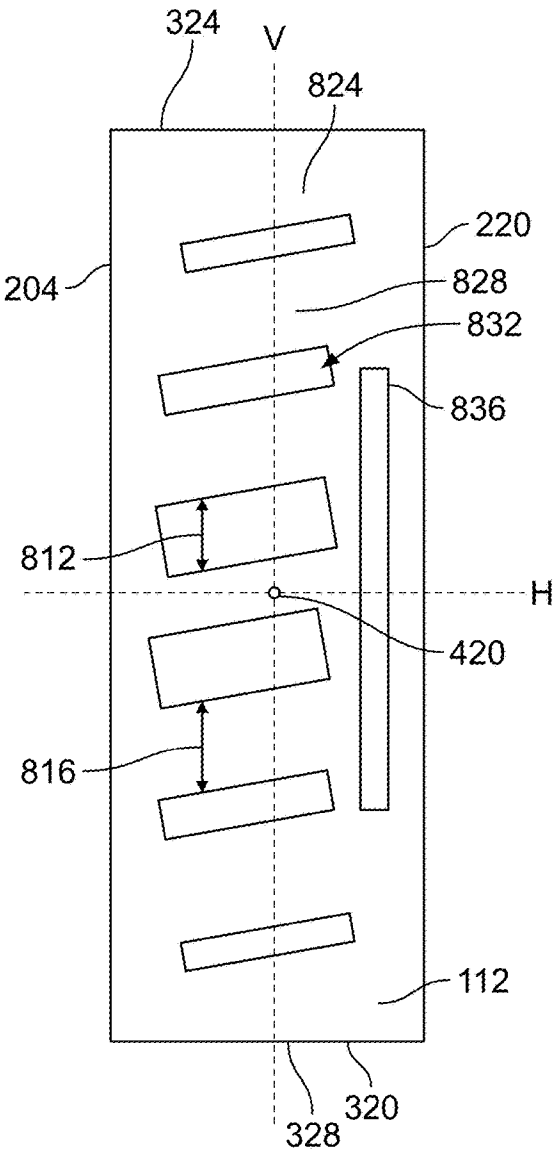
FIG. 8 is a schematic representation of a cross-sectional view of the face insert of FIG. 3 with another embodiment of a core.

Referring to FIG. 8, the face insert 112 is depicted with another embodiment of a core 824 having a plurality of ribs 828 and a plurality of channels 832 that include a rectangular cross-sectional profile. In the illustrated embodiment, the plurality of ribs 828 extend at an angle between the front wall 204 and the rear wall 220, such that the rectangular cross-section of the plurality of channels 832 are also angled. The plurality of ribs 828 and the plurality of channels 832 have varying sizes between the upper edge 324 and the lower edge 328 of the face insert 112. In the illustrated embodiment, the plurality of ribs 828 increase in size in an outward direction relative to the geometric center 420, such that the thickness 816 increases moving away from the horizontal axis H toward the periphery 320. Relatedly, the plurality of channels 832 decrease in size in the outward direction relative to the geometric center 420, such that the distance 812 decreases moving away from the horizontal axis H toward the periphery 320. Further, the plurality of channels 832 are arranged to be disposed forwardly relative to the vertical axis V, i.e., closer to the front wall 204, moving inwardly from the periphery 320 toward the horizontal axis H. That is, channels 832 disposed closest to the horizontal axis H are formed closest to the front wall 204. Additionally, the core 824 includes a pocket or chamber 836 near the rear wall 220, rearwardly of at least some of the plurality of channels 832. In this way, the core 824 is configured to include less material near the geometric center 420, such that the face insert 112 is more flexible near the geometric center 420, while more material and/or greater stiffness is provided near the periphery 320 surrounding the geometric center 420. It will be appreciated that the pocket 836 may include a solid member (not shown), such as a rigid plate or a fill material, for stiffening at least a portion of the face insert 112. In some embodiments, the solid member (not shown) may be composed of a different material than the material used to form the face insert 112 or the core 208. In some embodiments, the solid member (not shown) is inserted within the pocket 836, such as through the periphery 320 of the face insert 112. In other embodiments, the solid member (not shown) is integrally formed with the face insert 112, such as by a co-molding or insert molding process. In some embodiments, the solid member (not shown) is attached to the face insert 112 inside of the pocket 836, such as by fastening members, adhesive, interference fits, or the like. In still other embodiments, the solid member (not shown) is a fill material that may be injected, poured, or otherwise provided within the pocket 836, such that a volume of the pocket 826 is at least partially occupied by the fill material. Further, the pocket 836 may be disposed entirely rearwardly of the vertical axis V, as illustrated in FIG. 8. Alternatively, the pocket 836 may be positioned forwardly of the vertical axis V and/or adjacent the front wall 204. It is contemplated that there may be multiple pockets 836 provided in the face insert 112 in various positions relative to the horizonal axis H and the vertical axis V.

Figure 9:
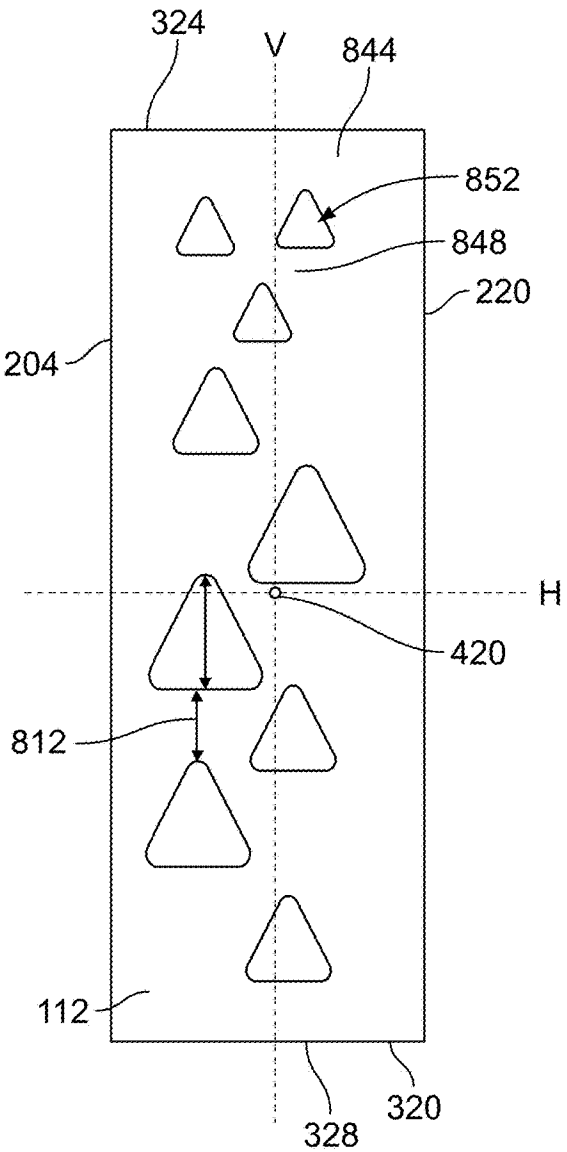
FIG. 9 is a schematic representation of a cross-sectional view of the face insert of FIG. 3 with still another embodiment of a core.

Referring to FIG. 9, the face insert 112 is depicted with another embodiment of a core 844 having a plurality of ribs 848 and a plurality of channels 852 that include a triangular cross-sectional profile. In the illustrated embodiment, the plurality of channels 852 are arranged in an irregular pattern with some channels 852 being disposed entirely forward of the vertical axis V and other channels 852 being disposed farther rearward. Additionally, the plurality of channels 852 vary in size between the upper edge 324 and the lower edge 328 and between the front wall 204 and the rear wall 220 of the face insert 112. In the illustrated embodiment, the plurality of channels 852 increase in size in an inward direction relative to the geometric center 420, such that the distance 812 increases moving toward the horizontal axis H away from the periphery 320. Further, the plurality of ribs 848 are irregularly shaped and, in some instances, are interrupted by one or more channels 852 between the front wall 204 and the rear wall 220. The plurality of channels 852 are illustrated as having generally rounded corners to form the triangular cross-section, although other configurations are possible. In some embodiments, the cross-sectional profile of the plurality of channels 852 may resemble an acute triangle, a right triangle, an obtuse triangle, a scalene triangle, an isosceles triangle, or an equilateral triangle.

Prior to printing a complex geometrical structure through additive manufacturing, a structural topology, the shape and size of the profiles, and the material used for 3D printing is optimized. The structural topology, shape, and the material properties are optimized through a numerical method called a topology optimization. The topology optimization optimizes the total weight of the created part, maximizes the mechanical properties of the created part, and achieves optimal material distribution in a given volume subjected to mechanical constraints and/or other desirable properties. Different numerical models such as, but not limited to, a size optimization strategy, wherein the aim is to find the optimal dimensions of the structural components, a shape optimization strategy, wherein the shape of the structure is parameterized and optimized, and a topology optimization strategy wherein the optimal spatial distribution of the structural material or components is determined, may be implemented to optimize an initial design part. The mechanical properties such as stress distribution, strain distribution, strength, ductility, mechanical loads, and/or other important mechanical properties of the initial design part are evaluated. The initial CAD model is optimized by removing the materials and redistributing the materials based on the numerical evaluation on the initial CAD model and an optimized CAD model is created. The optimized CAD model is used to create an optimized lightweight structure. Typically, the lightweight structure comprises a plurality of lattice structures. In some embodiments, the lattice structure may vary in one or more of the following unit cell type, unit cell geometry, unit cell size, segment length, segment thickness, segment volume and unit cell density at one or more locations along the perimeter of the printed part.

Figure 10:
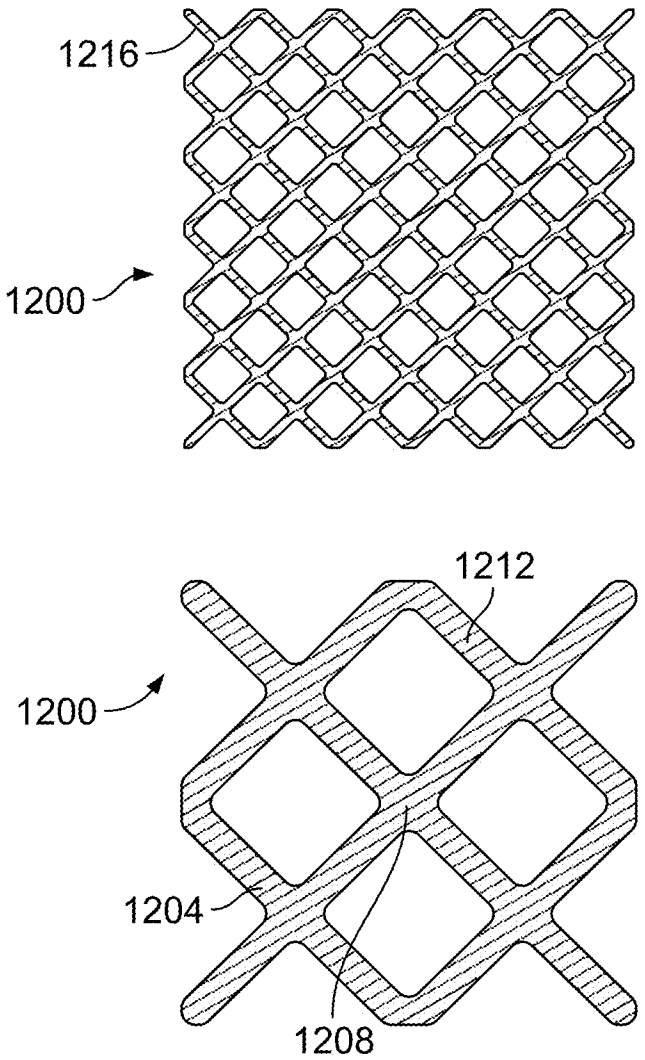
FIG. 10 displays various configurations of a lattice structure for use with the face inserts of the present disclosure.

With reference to FIG. 10, a lattice structure 1200 may define a unit cell 1204 or an open cell geometry that is formed by a cut out or absence of material defined between a plurality of nodes 1208 that occur along a common plane. In the illustrated embodiment, various configurations of the lattice structure 1200 are depicted, including lattice 1204 that defines a square, a rectangular, or a diamond-shaped unit cell. The diamond-shaped unit cell configuration as shown in the present disclosure provides structural benefits such as high capacity to withstand compression, high strength-to-weight ratio, and minimized unbraced length of individual segments comprising the lattice structure 1200. However, the lattice structure 1204 illustrated in FIG. 10 is not limited to the shape of the unit cell and alternative geometries may be utilized. For example, a triangular shaped cutouts or air spaces may be used along the outer perimeter of the defined lattice structure. Alternatively or additionally, at least a portion of the unit cells in a lattice structure 1200 may define a pentagonal shape, a hexagonal shape, or any other type of polygonal shape. The lattice structure 1200 comprises plurality of nodes 1208 and a plurality of segments 1212. The segments 1212 are centered around the node 1208. The lattice structure 1200 may be extrapolated to produce a lattice matrix 1216. In some embodiments, a unit cell defined by the lattice structure 1200 can be formed by interconnecting shapes (e.g., ovals, circles, or other geometric shapes) with varying orientations to form a repeated pattern, or unit cell 1204.

Regardless of the design and properties of the lattice structure 1200, a putter-type golf club head 100 according to the present disclosure may be manufactured via additive manufacturing. For example, a square-type lattice structure 1200 may be formed integrally with a face insert 112 of the golf club head 100. In some embodiments, referring to FIG. 11, an alternating lattice structure 1300 along the plurality of ribs 216 extending along the plurality of channels 212 is shown. The incorporation of the alternating lattice structure 1300 into a putter-type golf club head 100 may provide several manufacturing, performance, and customizable benefits, such as but not limited to light weight, feel, improved sound characteristics, and increase in shot distance. In some embodiments, a lattice structure 1200 may be utilized to optimize the center of gravity (CG) by redistributing the mass throughout the golf club head 100. In this way, the removed mass may be relocated elsewhere on the golf club head to improve the performance as well as the structural integrity of the golf club head 100.

Figure 11:
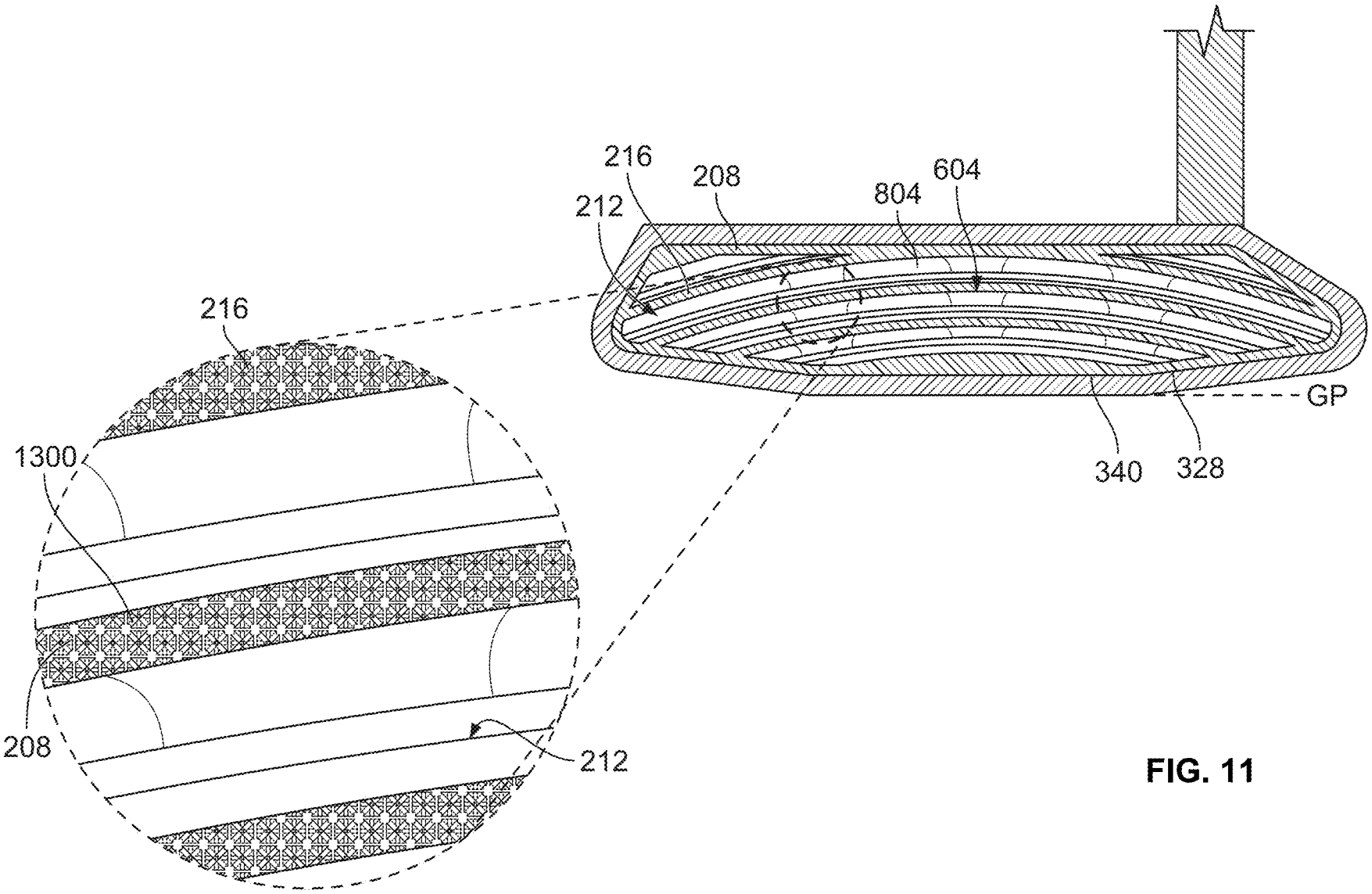
FIG. 11 is a cross-sectional view of the golf club head of FIG. 1 taken along the line 11-11 with an enlarged view of a portion of the face insert including a lattice structure.

Referring to FIG. 11, the plurality of ribs 216 may include an alternating lattice structure 1300. The incorporation of the lattice structure 1300 in or near the front wall 204 (see FIG. 2) of the face insert 112 may provide reinforcement and, thus, increased strength and durability, which can afford for reduced thickness of the face insert 112, i.e., between the front wall 204 and the rear wall 220, and/or reduced thickness of the front wall 204 itself. Referring back to FIG. 4, the thickness 416 between the front wall 204 and the cross-sectional profile 384 of the face insert 112 may be reduced to provide flexibility, e.g., a trampoline effect, for launching the golf ball from the face insert 112 during the impact. That is, the incorporation of the lattice structure 1300 along the ribs 216 may provide additional stiffness while the reduced thickness of the front wall 204, induced by the arched pattern 804, plurality of channels 212, and/or the lattice structure 1300 along the ribs 216, may provide improved flexibility. The additional stiffness is desirable to prevent local deformation during the printing process, as warping can occur when printing an extended flat or planar member.

In some embodiments, the face insert may be printed with different materials. The face insert 112 may be divided into multiple layers along the thickness direction and each layer may be printed individually using a different material. The 3D CAD part may be sliced into a plurality of 2D layers along the thickness direction. The 3D CAD part may be sliced into 2D layers based on the thicknesses suggested by the topology optimization. The topology optimization may be based on material properties. For example, the striking face layer may be made from a stiffer material such as a thermoset polymer and the rear plate may be made from a softer polymer to provide vibration dampening. The topology optimization may be based on the topology of the 3D structure, where the optimal thickness of the plurality of channels may be determined and a desirable material may be selected. For example, the layer between the front plate and the rear plate comprising the plurality of channels may be printed using a stiffer material. The topology optimization may be optimized to provide desirable auditory and vibratory feedback to the golfer. The topology optimization may be optimized to provide an efficient and cost-effective manufacturing process.

Figure 12:
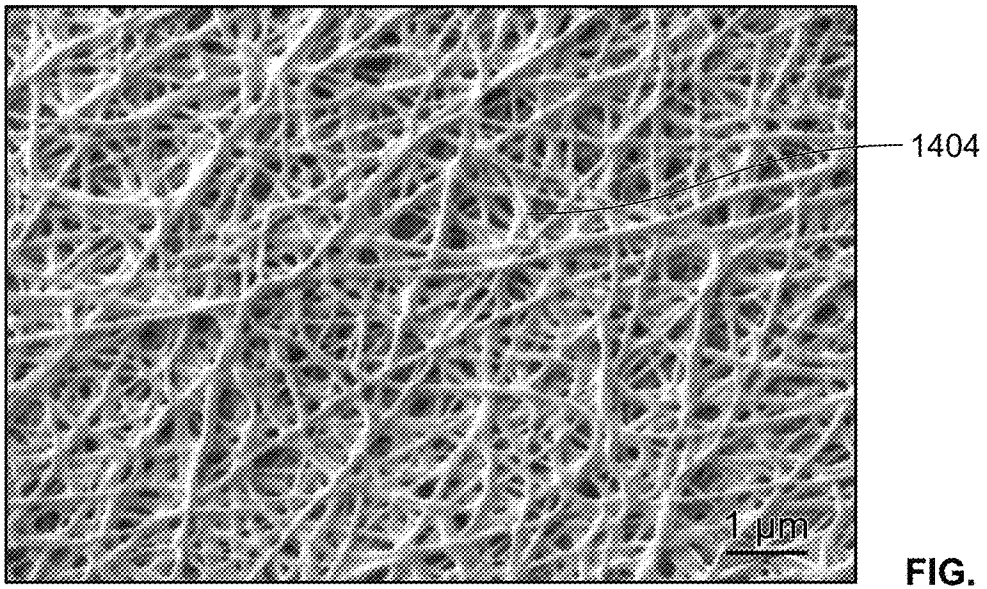
FIG. 12 is an enlarged view of a portion of a lattice structure for use with the face insert of the present disclosure.

During manufacture, when the build plane is oriented parallel to the front normal face, each portion of the lattice structure may be printed at an angle greater than or equal to 30 degrees relative to the build plate to ensure that the lattice structure is self-supporting and does not require support structure. FIG. 12 depicts the microscopic cross-section of a printed part. The chains of the liquid photopolymers show a dense net pattern 1404. The photopolymers activated by a light source, an ultraviolet (UV) light source, or an electromagnetic spectrum induce the monomers, oligomers, and photo-initiators in the liquid photopolymer to cross link and bond together creating a net structure and hardening of the polymeric material through a process called curing. The monomers are used in UV curable systems to help control the speed of cure, crosslink density, final surface property, and the viscosity of the resin. The monomers include, but are not limited to, styrene, N-Vinylpyrrolidone, and acrylates. The oligomer provides flexibility, adhesion, and chemical resistance to a photocured material and is functionalized by the monomers. The oligomers include, but are not limited to, epoxides, urethanes, and polyesters. The photopolymerized systems are cured through UV since UV light is more energetic. However, visible light may be used for the curing process.

Figure 13:
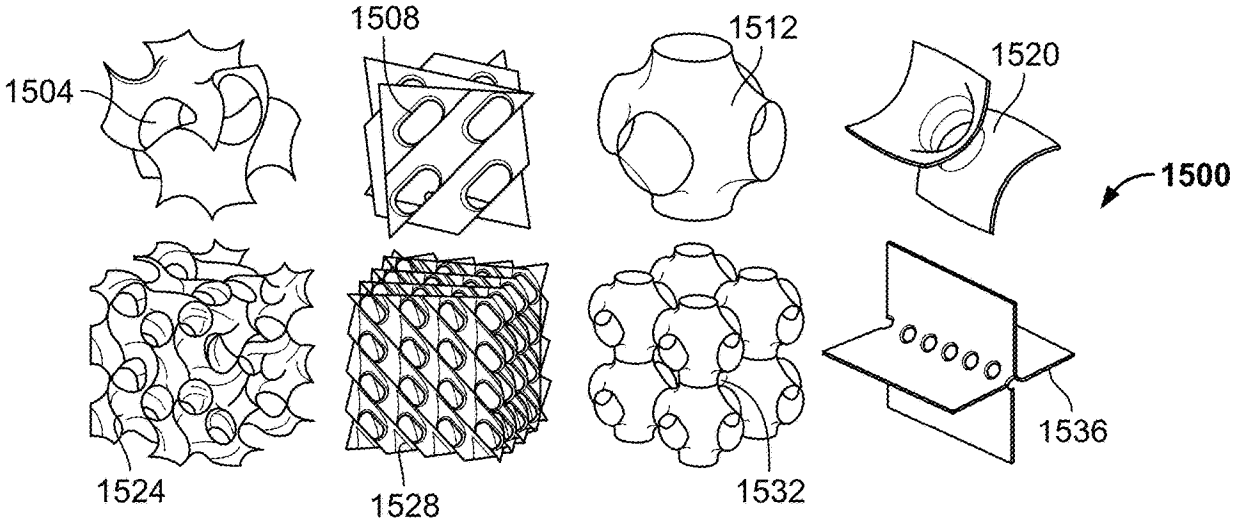
FIG. 13 displays various configurations of a lattice structure for use with the face insert of the present disclosure.

In some embodiments, a lattice structure according to the present disclosure may be formed by a differential geometry structure 1500. FIG. 13 depict different types of differential geometry structures, a first differential geometry 1504 or a gyroid, a second differential geometry 1508, a third differential geometry 1512, a fourth differential geometry 1520, a fifth differential geometry 1524, a sixth differential geometry 1528, a seventh differential geometry 1532, and an eighth differential geometry 1536. The gyroid structure 1504 may define a unit cell that is repeated in a pattern over a desired volume to form a lattice structure. In general, differential geometry structure may reduce stress concentrations formed along the lattice structures due to the reduction of sharp edges and redistribute the mechanical loads along the lattice structure.

In some embodiments, two-part urethanes may be used instead of photopolymers for digital light synthesis (DLS). The DLS 3D printer uses a photochemical process that cures liquid plastic resin into solid parts using ultraviolet light known as the continuous liquid interface production process. The process works by projecting UV light through an oxygen-permeable window into a vat of UV-curable resin. The UV light passes through the window and cures the resin between the window and directly above the solid part. As a sequence of UV images is projected layer by layer, the part solidifies, and the building platform rises. The two-part urethanes will require a thermal cycle after they are built to reach their final properties, providing enhanced isotropic mechanical properties and durable parts for end use. The part prior to thermocycle is called a green part. The green part is subjected to a thermal cycle where the part is baked in a forced circulation oven to secondary-chemical reaction that causes materials to adapt and strengthen and creating a cured end part. For example, the Young's modulus of the green part may be between about 250 MPa and about 280 MPa after the part is detached from the printing platform. After the green part is subjected to heat cycle through baking, the isotropy of the part strengthens in all directions increasing the Young's modulus between about 3800 MPa and 4000 MPa.

It will be appreciated that the core 208 comprising the plurality of ribs 216 and the plurality of channels 212 may be useful for directing or controlling energy. When compressive forces are applied to the face insert 112, such as when striking a golf ball, the plurality of ribs 216 may deform or bend between the front wall 204 and the rear wall 220 to absorb energy. When the compressive forces are removed, e.g., after striking the golf ball, the plurality of ribs 216 may revert, e.g., evert, back to their undeformed shape, thereby releasing the energy stored therein. In addition, the face insert 112 comprising the plurality of ribs 212 may exhibit linear elastic properties which are limited by a predetermined stress, i.e., the stress necessary to cause the plurality of ribs 216 to deform. This energy absorption and return is further controlled by the arched pattern 804 in which the plurality of ribs 216 are arranged. That is, the plurality of ribs 216 and portions thereof are configured in the arched pattern 804 to afford deformation and return over a range of time periods or intervals in response to the compressive forces associated with striking a golf ball, such that the energy returned to the golf ball may impart top spin and/or corrective spin depending on the location of impact.

Figure 14:
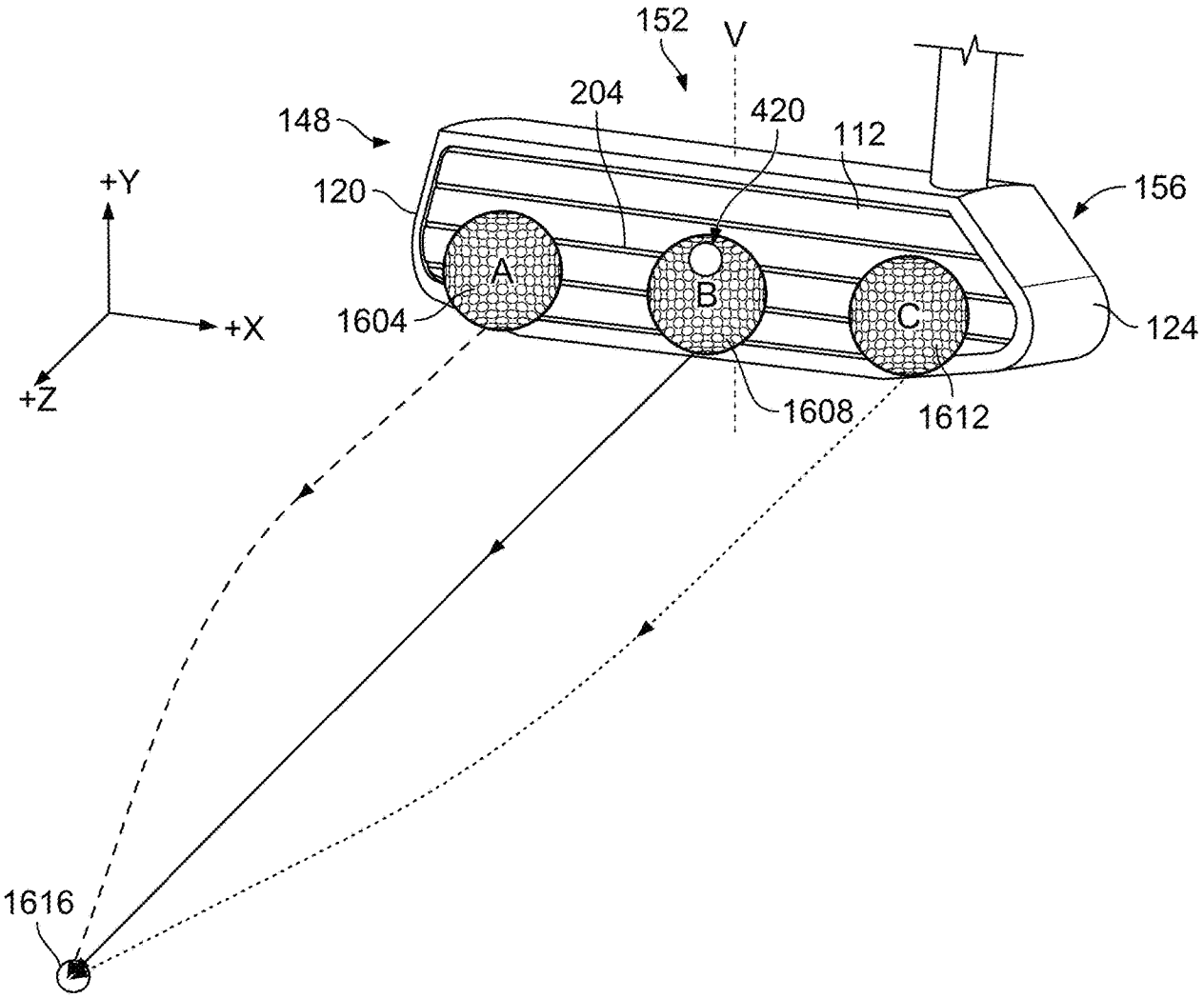
FIG. 14 is a schematic representation of various configurations of the golf club head impacting a golf ball.

Referring to FIG. 14, the putter-type golf club head 100 is schematically depicted with a golf ball at various striking positions or impact locations 1600. As illustrated, a golf ball A is depicted as traveling along path 1604 after impact with the face insert 112 of the putter-type golf club head 100 in the toe region 148, in which a corrective draw spin is imparted to the golf ball A. Golf ball B is depicted as traveling along path 1608 after impact with the face insert 112 of the putter-type golf club head 100 in the medial region 152 and aligned with the geometric center 420. Golf ball C is depicted as traveling along path 1612 after impact with the face insert 112 of the putter-type golf club head 100 in the heel region 156, in which a corrective cut spin is imparted to the golf ball C. Due to impact, each of the golf balls A, B, C, departs from the face insert 112 with a force vector profile, as indicated by directional arrows in FIG. 14 for illustrative purposes. Each force vector profile includes an X component, a Y component, and a Z component. Each of the X, Y, and Z components includes a magnitude, which may have units of Newtons (N), and a positive or negative direction, which may be defined with respect to the ground plane GP and the geometric center 420 of the face insert. The X component includes an X direction and magnitude, the Y component includes a Y direction and magnitude, and the Z component includes a Z direction and magnitude. It will be appreciated that when the Y component is positive and has a non-zero magnitude, topspin is imparted to the golf ball. Conversely, when the Y component is negative and has a non-zero magnitude, backspin is imparted to the golf ball. When the Z component is positive and has a non-zero magnitude, forward movement is imparted to the golf ball. When the X component is positive, e.g., pointing toward a right side of the page, and has a non-zero magnitude, draw spin is imparted to the golf ball. Conversely, when the X component is negative, e.g., pointing toward a left side of the page, and has a non-zero magnitude, cut spin is imparted to the golf ball. When any of the X, Y, or Z components have zero magnitude, no force and, thus, no spin is imparted to the golf ball in the respective direction.

As illustrated in FIG. 14, impact between the face insert 112 and the golf ball A imparts a force vector profile having a positive Y direction, i.e., away from the ground plane GP, and a non-zero magnitude, a positive Z direction, i.e., away from the face insert 112, and a non-zero magnitude, and a negative X direction, i.e., heelward, and a non-zero magnitude. In this way, the force vector profile can be described as +X, +Y, −Z, which results in topspin and corrective draw spin that engages the ground, i.e., the grass or turf of the putting green, via frictional forces that are equal and opposite to the force vector profile, to cause the golf ball A to travel along the path 1604 toward a projected destination 1616 that is axially aligned with the geometric center 420 of the face insert 112. The corrective draw spin force vector profile of golf ball A is provided by the arched pattern 804 of the core 208 formed in the face insert 112.

In another aspect, impact between the face insert 112 and the golf ball B imparts a force vector profile having a positive Y direction and non-zero magnitude, a positive Z direction and a non-zero magnitude, and an X component have zero magnitude. Accordingly, the golf ball B is imparted with only a top spin and forward movement, such that the golf ball B travels along the path 1608 that is axially aligned with the geometric center 420 of the face insert 112 and the projected destination 1616. With exception to deviations cause by slopes, undulations, obstacles, imperfections, and other conditions of the ground surface or putting green, the golf ball B travels straight along the path 1608 toward the projected destination 1616.

In still another aspect, impact between the face insert 112 and the golf ball C imparts a force vector profile having a positive Y direction and a non-zero magnitude, a positive Z direction and a non-zero magnitude, and a positive X direction, i.e., toeward, and a non-zero magnitude. In this way, the force vector profile can be described as +X, +Y, +Z, which results in topspin and corrective cut spin that engages that ground via frictional forces to cause the golf ball C to travel along the path 1612 toward the projected destination 1616 that is axially aligned with the center of the face insert 112. The corrective cut spin force vector profile of golf ball C is provided by the arched pattern 804 of the core 208 formed in the face insert 112.

Because the force vector profile of each golf ball A, B, C includes a Y component that is positive and has a non-zero magnitude, topspin is imparted across the entire face insert 112 to minimize any skidding distance from the face insert 112 after impact. It is contemplated that the magnitude of the Y component and, thus, the magnitude of the topspin varies across the face insert 112 as determined by the configuration of the core 208 and/or materials of the face insert 112, among other factors. In some embodiments, the face insert 112 is composed of a material having a Shore A hardness of between about 80 A and about 95 A. In some embodiments, the face insert 112 has a Shore A hardness of less than 95 A. Further, the core 208 and the face insert 112 may be formed as a unitary component of the same material. Alternatively, the face insert 112 and the core 208 may be formed of different materials, although still being formed integrally as a unitary component, depending on the manufacturing techniques used. In some embodiments, the core 208 and the face insert 112 are composed of different materials, such that the plurality of ribs 216 are made of a different material than the front wall 204 or the rear wall 220, or both. In some embodiments, the face insert 112 and core 208 may be configured to impart topspin of uniform magnitude across the entire face insert 112. Further, by varying the radius of curvature that defines the arched pattern 804 relative to the ground plane GP within the toe region 148, the core 208 can be configured to impart greater or smaller magnitude of the X component in the negative direction, which results in greater or smaller magnitude of draw spin. In this way, the core 208 can be customized or optimized to provide more or less corrective draw spin on the golf ball impacting the face insert 112 in the toe region 148. In a similar fashion, by varying the radius of curvature that defines the arched pattern 804 relative to the ground plane GP within the heel region 156, the core 208 can be configured to impart greater or smaller magnitude of the X component in the positive direction, which results in greater or smaller magnitude of cut spin. In this way, the core 208 can be customized or optimized to provide more or less corrective cut spin on the golf ball impacting the face insert 112 in the heel region 156.

Accordingly, the face insert 112 with the core 208 is configured to be more forgiving and more efficient as compared to conventional face inserts. That is, the face insert 112 provides improved control and accuracy of shots made with putter-type golf club head 100 and, specifically, the face insert 112 and the core 208 are configured to improve control and accuracy of off-center shots, i.e., when the impact location is offset heelward or toeward of the geometric center 420 of the face insert 112. To that end, the top spin generated at impact reduces the skid distance, i.e., the distance to forward rotation of the golf ball. Further, the face insert 112 and core 208 provides corrective spin when the golf ball is struck off-center, e.g., in the toe region 148 or the heel region 156. This top spin and corrective spin is, in part, due to the configuration of the core 208, such as, e.g., the arched pattern 804 and the cross-sectional profile 384, as illustrated and discussed in connection with FIG. 14. As result, off-center shots, e.g., the golf balls A and C, travel toward the same destination 1616 as on-center shots, e.g., the golf ball B. Further, off-center shots taken with conventional golf club heads and/or face inserts often result in shorter shot distances. With the golf club head 100 and face insert 112 of the present disclosure, the reduction in skid distance and the conversion of top spin into corrective cut or draw spin affords for the off-center shots to travel approximately the same distance as on-center shots. That is, the face insert 112 of the present disclosure has improved efficiency across the striking face, such that the velocity in, i.e., swing speed, is translated to velocity out, i.e., ball speed, at a greater rate than conventional golf club heads and/or face inserts. It will also be appreciated that the face insert 112 having the core 824 of FIG. 8 or the core 844 of FIG. 9 also provides improved forgiveness and efficiency compared to conventional golf club heads and/or face insert. It will further be appreciated that the face insert 112 of the present disclosure may weigh less than conventional face inserts due to the core 208, e.g., because the plurality of channels 212 represent the removal of or absence of a volume of material. Similarly, the face insert 112 having the core 824 or the core 844 also may weigh less than conventional face inserts.

As illustrated in Table 1, below, a trial was performed comparing the on-center shot performance of a golf club head having a conventional face insert with golf club heads and face inserts of the present disclosure, and various parameters were measured using a putting analysis software system that utilizes a high-speed camera. In the trial, both 10-foot and 30-foot putts were performed with the golf ball being hit on-center, e.g., as represented by golf ball B of FIG. 14. The Conventional Face Insert used was a solid structure, e.g., without any voids therein. The Face Insert Embodiments 1, 2, and 3 are similar in all respects to the face insert 112 and each include the core 208 therein, except that the Face Insert Embodiments 1, 2, and 3 have different Shore A Hardness values from one another. It will be appreciated that the empirical values provided herein are exemplary and are not intended to limit the disclosure, as empirical values may vary according to various factors, such as, e.g., the precise golf balls used, weather conditions, wind speed and direction, topology of the ground or putting green, among others.

TABLE 1

| Trial 1 | | Conventional Face Insert | Face Insert Embodiment 1 | Face Insert Embodiment 2 | Face Insert Embodiment 3 |
|---|---|---|---|---|---|
| | Hardness | Shore A 95 | Shore A 95 | Shore A 90 | Shore A 85 |
| 10-Foot Putt | Launch (deg) | 5.31 | 3.58 | 3.15 | 2.81 |
| | Skid Distance(in) | 4.97 | 0 | 0 | 0 |
| | Roll (RPM) | −36 | 28 | 26 | 37 |
| | Sidespin (RPM) | −9 | −7 | −10 | −18 |
| 30-Foot Putt | Launch (deg) | 5.45 | 5.12 | 3.02 | 2.64 |
| | Skid Distance (in) | 8.24 | 0 | 0 | 0 |
| | Roll Spin (RPM) | −51 | 41 | 49 | 30 |
| | Side Spin (RPM) | −14 | −1 | −19 | −30 |

As can be appreciated from Table 1, although the Face Insert Embodiment 1 and the Conventional Face Insert have identical Shore A Hardness, the inclusion of the core 208 within the Face Insert Embodiment 1 provided a forward roll spin of 28 RPM for the 10-foot putt and 41 RPM for the 30-foot putt in contrast to the backspins of 36 RPM and 51 RPM, respectively, of the Conventional Face Insert. Similarly, the Face Insert Embodiments 2 and 3, each having the core 208 therein, also produced forward roll spins instead of backspins, regardless of the putt distance. Further, only the Conventional Face Insert resulted in a measured skid distance, which nearly doubled from the 10-foot putt to the 30-foot putt.

As illustrated in Table 2, below, another trial was performed comparing the off-center heelward shot performance of a golf club head having a conventional face insert with golf club heads and face inserts of the present disclosure, and various parameters were measured using a putting analysis software system that utilizes a high-speed camera. In the trial, both 10-foot and 30-foot putts were performed with the golf ball being hit off-center heelward, e.g., as represented by golf ball C of FIG. 14.

TABLE 2

| | Trial 2 | Conventional Face Insert | Face Insert Embodiment 1 | Face Insert Embodiment 2 | Face Insert Embodiment 3 |
|---|---|---|---|---|---|
| | Hardness | Shore A 95 | Shore A 95 | Shore A 90 | Shore A 85 |
| 10-Foot | Launch (deg) | 3.6 | 3.1 | 2.5 | 0.4 |
| Putt | Skid Distance (in) | 3.4 | 0.4 | 0.2 | 0 |
| | Roll (RPM) | −40 | 4 | 15 | 28 |
| | Sidespin (RPM) | −2 | 8 | 9 | 5 |
| 30-Foot | Launch (deg) | 3.4 | 3.6 | 2.7 | 0.9 |
| Putt | Skid Distance (in) | 6.5 | 0 | 0 | 0 |
| | Roll Spin (RPM) | −47 | 19 | 29 | 32 |
| | Side Spin (RPM) | 6 | 9 | 7 | 9 |

As can be appreciated from Table 2, although the Face Insert Embodiment 1 and the Conventional Face Insert have identical Shore A Hardness, the inclusion of the core 208 within the Face Insert Embodiment 1 provided a forward roll spins of 4 RPM for the 10-foot putt and 19 RPM for the 30-foot putt in contrast to the backspins of 40 RPM and 47 RPM, respectively, of the Conventional Face Insert. Similarly, the Face Insert Embodiments 2 and 3, each having the core 208 therein, also produced forward roll spins instead of backspins, regardless of the putt distance. Further, the Conventional Face Insert resulted in a measured skid distance of 3.4 inches for the 10-foot putt, which nearly doubled for the 30-foot putt. By contrast, for the 10-foot putt, the Face Insert Embodiment 1 resulted in a skid distance of 0.4 inches and the Face Insert Embodiment 2 resulted in a skid distance of 0.2 inches. However, no skid distance was measured for the Face Insert Embodiments 1, 2, and 3 for the 30-foot putts.

Additionally, the Conventional Face Insert produced a side spin of 2 RPM and 6 RPM in a fade or draw direction when impacted heelward of center, which indicates that the golf ball diverged farther from the projected destination 1616 (see FIG. 14) along its forward path. By contrast, each of the Face Insert Embodiments 1, 2, and 3 produced corrective fade or cut spins when impacted heelward of center for both the 10-foot putt and the 30-foot putt, which indicates that the golf ball traveled toward the projected destination 1616 along its forward path for both short and long shots.

As illustrated in Table 3, below, another trial was performed comparing the off-center toeward shot performance of a golf club head having a conventional face insert with golf club heads and face inserts of the present disclosure, and various parameters were measured using a putting analysis software system that utilizes a high-speed camera. In the trial, both 10-foot and 30-foot putts were performed with the golf ball being hit off-center toeward, e.g., as represented by golf ball A of FIG. 14.

TABLE 3

| | Trial 3 | Conventional Face Insert | Face Insert Embodiment 1 | Face Insert Embodiment 2 | Face Insert Embodiment 3 |
|---|---|---|---|---|---|
| | Hardness | Shore A 95 | Shore A 95 | Shore A 90 | Shore A 85 |
| 10-Foot | Launch (deg) | 6.8 | 5.9 | 2.8 | 3.5 |
| Putt | Skid Distance (in) | 2.6 | 0 | 0 | 0 |
| | Roll (RPM) | −32 | 24 | 38 | 26 |
| | Sidespin (RPM) | −14 | −37 | −36 | −16 |
| 30-Foot | Launch (deg) | 7.1 | 6.4 | 2.9 | 4 |
| Putt | Skid Distance (in) | 7.6 | 0 | 0 | 0 |
| | Roll Spin (RPM) | −23 | 42 | 48 | 24 |
| | Side Spin (RPM) | −24 | −51 | −51 | −37 |

As can be appreciated from Table 3, although the Face Insert Embodiment 1 and the Conventional Face Insert have identical Shore A Hardness, the inclusion of the core 208 within the Face Insert Embodiment 1 provided a forward roll spins of 24 RPM for the 10-foot putt and 42 RPM for the 30-foot putt in contrast to the backspins of 32 RPM and 23 RPM, respectively, of the Conventional Face Insert. Similarly, the Face Insert Embodiments 2 and 3, each having the core 208 therein, also produced forward roll spins instead of backspins, regardless of the putt distance. Further, only the Conventional Face Insert resulted in a measured skid distance, which nearly doubled from the 10-foot putt to the 30-foot putt.

Additionally, the Conventional Face Insert produced a side spin of 14 RPM and 24 RPM in a hook or draw direction when impacted heelward of center, which indicates that the golf ball traveled slightly toward the projected destination 1616 (see FIG. 14) along its forward path. However, each of the Face Insert Embodiments 1, 2, and 3 produced greater corrective hook or draw spins, e.g., more than double the magnitude of the side spins of the Conventional Face Insert, when impacted toeward of center for both the 10-foot and 30-foot putts. Accordingly, the results indicate that the golf ball impacted by the Face Insert Embodiments 1, 2, and 3 traveled toward the projected destination 1616 along its forward path for both short and long shots.

Figure 15:
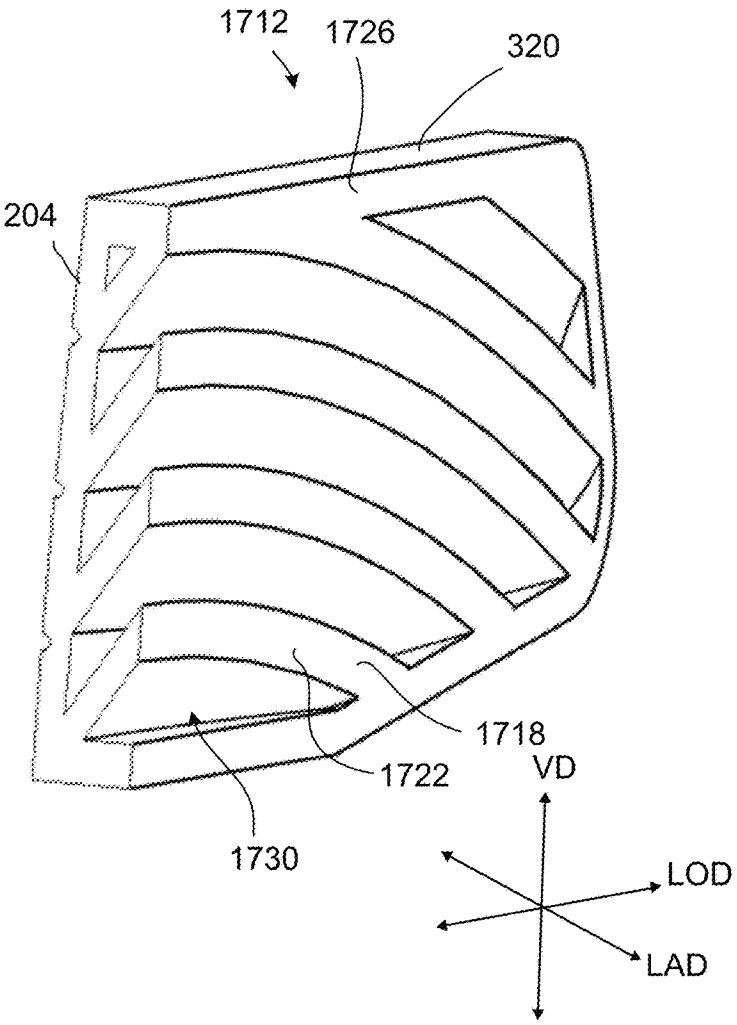
FIG. 15 is a cross-sectional, perspective view of a portion of another embodiment of a face insert having a core.

Turning to FIG. 15, another embodiment of a face insert 1712 is depicted with a core 1718. Elements of the face insert 1712 shared with the face insert 112, such as elements having similar function or structure, will be indicated using like reference numerals. In the illustrated embodiment, the core 1718 comprises a plurality of ribs 1722 that extend rearwardly from the front wall 204 to a rear side 1726. A plurality of channels 1730 are defined between adjacent ribs 1722 spaced apart vertically across the face insert 1712. In the illustrated embodiment, the plurality of channels 1730 are open and exposed at the rear side 1726 of the face insert 1712, so as to define openings at the rear side 1726 of the face insert 1712. This may be understood as an exposed core configuration or a single-side face insert in which the core 1718 is provided on only the front wall 204, such that the core 1718 is disposed internally between the front wall 204 and the rear side 1726 of the face insert 1712 and encased within or surrounded by the periphery 320 of the face insert 1712. It will also be appreciated that when the face insert 1712 is disposed within the face cavity 116 (see FIG. 2), the rear side 1726 is configured to face the body 108 and the plurality of channels 1730 of the core 1718 are configured to be enclosed by the cavity seat 232 within the face cavity 116. Referring to FIG. 15, it will be appreciated that the periphery 320 of the face insert 1712 is entirely solid and closed, such that there are no openings or slots formed therethrough for communication with the plurality of channels 1730 of the core 1718. Thus, in this embodiment, the plurality of channels 1730 are exposed only on the rear side 1726 of the face insert 1712. In addition, the plurality of ribs 1722 extend rearwardly and upwardly, similar to the plurality of ribs 216 of the core 208. The plurality of ribs 1722 are also curved relative to the periphery 320 across the heel-toe direction, similar to the arched pattern 804 of the core 208 (see FIG. 7).

Figure 16:
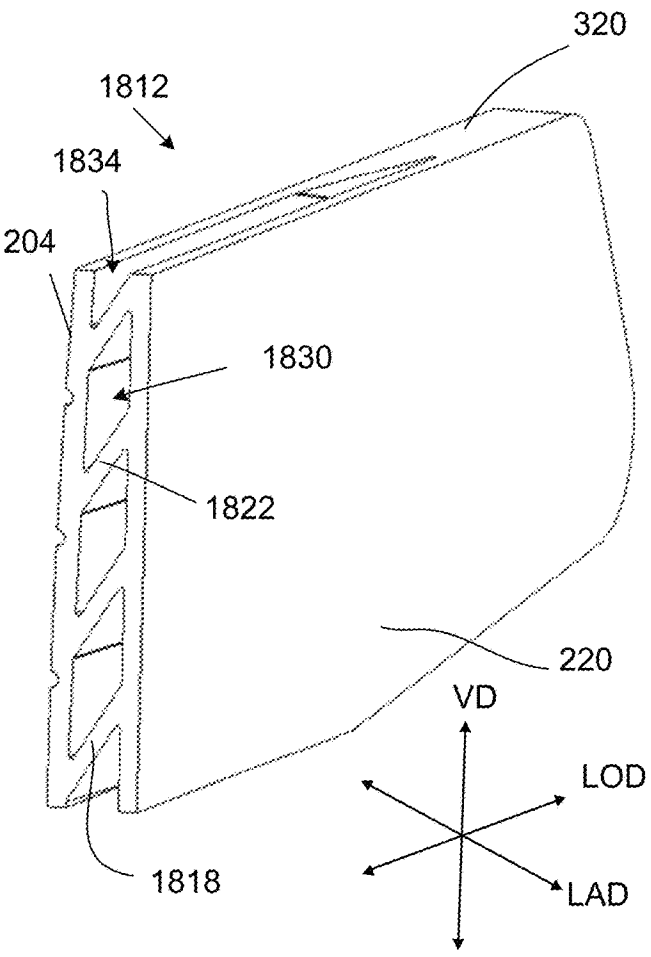
FIG. 16 is a cross-sectional, perspective view of a portion of yet another embodiment of a face insert having a core.

Turning to FIG. 16, yet another embodiment of a face insert 1812 is depicted with a core 1818. Elements of the face insert 1812 shared with the face insert 112, such as elements having similar function or structure, will be indicated using like reference numerals. In the illustrated embodiment, the core 1818 comprises a plurality of ribs 1822 that extend rearwardly from the front wall 204 toward the rear wall 220. A plurality of channels 1830 are defined between adjacent ribs 1822 spaced apart vertically across the face insert 1812. In the illustrated embodiment, the periphery 320 of the face insert 1812 comprises a plurality of openings 1834 formed therethrough and in communication with the core 1818, such that one or more channels 1830 may be exposed and in communication with one or more of the openings 1834. Accordingly, when the face insert 1812 is disposed within the face cavity 116 (see FIG. 2), the openings 1834 of the periphery 320 and the core 1818 may become enclosed by the body 108. It is contemplated that the openings 1834 may be arranged in various portions or regions of the face insert 1812 differently than shown in FIG. 16. It will be appreciated that the rear wall 220 of the face insert 1812 is entirely solid and uninterrupted as it extends across the periphery 320. In some embodiments, the rear wall 220 may be provided thickened areas (not shown), e.g., undulations or ridges or nubs or projections, which may provide increased stiffness or vibration dampening properties. Further, the plurality of ribs 1822 extend rearwardly and upwardly from the front wall 204, similar to the plurality of ribs 216 of the core 208, and the plurality of ribs 1822 are curved relative to the periphery 320 across the heel-toe direction, similar to the arched pattern 804 of the core 208 (see FIG. 7).

Figure 17:
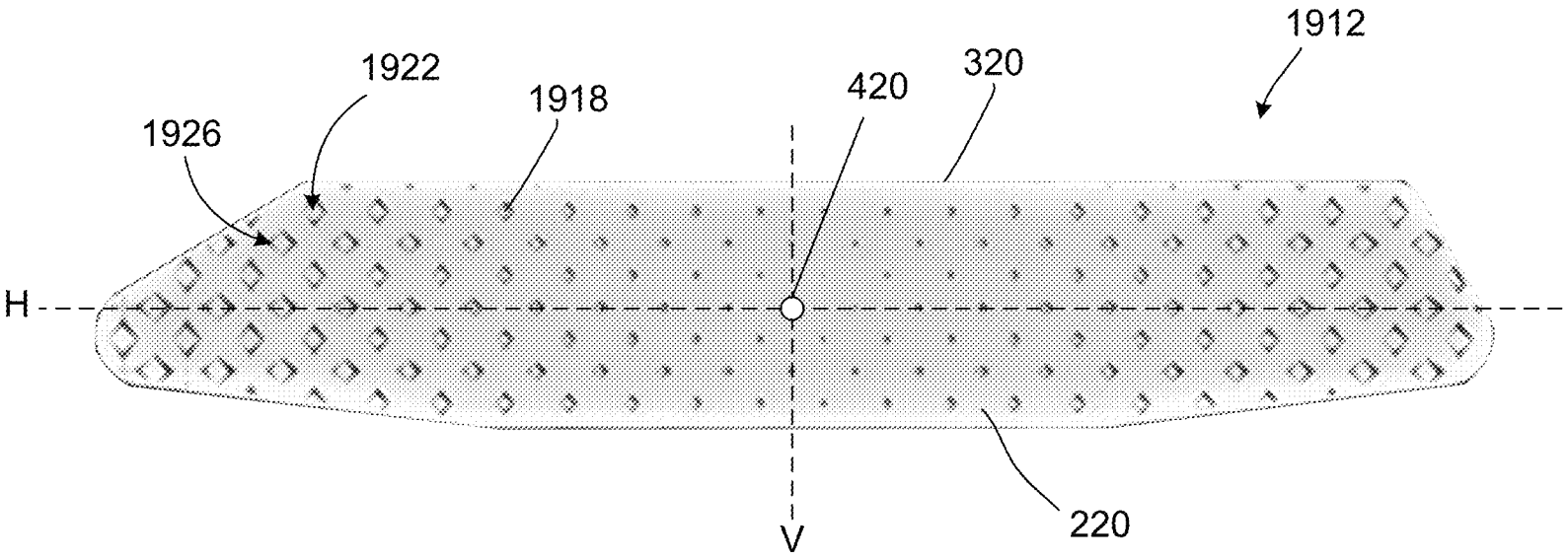
FIG. 17 is a rear view of still another embodiment of a face insert having a core.

Referring to FIG. 17, still another embodiment of a face insert 1912 is depicted with a core 1918. Elements of the face insert 1812 shared with the face insert 112, such as elements having similar function or structure, will be indicated using like reference numerals. In the illustrated embodiment, the core 1918 comprises a plurality of cavities 1922 in communication with a plurality of openings 1926 formed through the rear wall 220. The plurality of cavities 1922 and the plurality of openings 1926 may vary in size and shape across the face insert 1912, e.g., decreasing in size moving in an inward direction from the periphery 320 toward the geometric center 420 of the face insert 1912. Accordingly, the plurality of cavities 1922 and the plurality of openings 1926 arranged adjacent the periphery 320 may be larger in size than those arranged adjacent the geometric center 40. Relatedly, as a result of this arrangement, a density of the face insert 1912 may be greater adjacent the geometric center 420 and decrease, e.g., becomes more porous, moving toward the periphery 320. As illustrated in FIG. 17, the plurality of cavities 1922 and the plurality of openings 1926 may be generally diamond-shaped and may decrease in size, volume, and/or depth moving from the periphery 320 toward the geometric center 420. In some embodiments, the plurality of cavities 1922 and the plurality of openings 1926 can be differently shaped, such as, e.g., circular, elliptical, triangular, trapezoidal, rectangular, or irregularly shaped, from one face insert 1912 to the next and/or within the same face insert. In some embodiments, each of openings 1926 are provided as the same shape, uniformly across the face insert 1912, while in other embodiments, each of the openings 1926 may be shaped differently from one another or at least one of the openings 1926 may be shaped differently than other openings on the face insert 1912. Further, the plurality of cavities 1922 may be shaped identically to their respective openings 1926, or the plurality of cavities 1922 may be differently sized and/or shaped from their respective openings 1926 or from one another. Further, the plurality of cavities 1922 may be in communication with one another, such that a network of tunnels (not shown) is formed in the core 1918 internally within the face insert 1912. The plurality of openings 1926 can be arranged to increase in size, depth, and/or volume moving from the periphery 320 toward the geometric center 420, or moving in the vertical direction or the horizontal direction. In this way, the density of the face insert 1912 can be varied in one or more directions. Accordingly, when the face insert 1912 is disposed within the face cavity 116 (see FIG. 2), the plurality of openings 1926 and the plurality of cavities 1922 may become enclosed by the body 108, such as between the front wall 204 and the cavity seat 232 (see FIG. 2).

It is contemplated that the face inserts 1712, 1812, and 1912 can be manufactured using any of the techniques described herein, including conventional manufacturing techniques, such as, e.g., injection molding, or additive manufacturing techniques, such as, e.g., binder jetting. It will also be appreciated that any of the face inserts 1712, 1812, and 1912 may be provided with a pocket, similar to the pocket 836 of FIG. 8, which may be empty and/or hollow, or may be filled with solid material (not shown). Further, the face inserts 1712, 1812, and 1912 are also configured to provide the forgiveness and efficiency benefits described herein in connection with the face insert 112. That is, the face inserts 1712, 1812, and 1912 are also configured to improve accuracy and control of off-center hits, e.g., toeward or heelward of the geometric center 420.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples, and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A golf club head, comprising:

a body including a top portion that is opposite a sole, a heel region, a toe region, a medial region extending between the heel region and the toe region, and an insert cavity at a front side; and a face insert including a front wall, a rear wall, and a core, the face insert defining a periphery that includes a lower edge that is configured to be disposed parallel with a ground surface when the golf club head is at address, wherein the core includes a plurality of channels formed by a plurality of ribs extending concavely relative to the sole from the heel region to the toe region, and wherein the plurality of channels comprise at least 40% of a face insert volume.

2. The golf club head of claim 1, wherein the body and the face insert are formed of different materials.

3. The golf club head of claim 1, wherein the core is formed by an additive manufacturing process.

4. The golf club head of claim 1, wherein the core extends continuously across the face insert.

5. The golf club head of claim 1, wherein, when the face insert impacts a golf ball heelward of a geometric center, the core of the face insert is configured to impart a corrective cut spin, and when the face insert impacts a golf ball toeward of the geometric center, the core of the face insert is configured to impart a corrective draw spin.

6. The golf club head of claim 1, wherein the plurality of ribs extend at an inclined angle between the front wall and the rear wall.

7. A golf club head, comprising:

a body including a top portion that is opposite a sole, a toe region, a heel region, a medial region extending between the toe region and the heel region, and an insert cavity at a front side; and a face insert that includes a front wall, a rear wall, and a core, the face insert defining a periphery that includes a lower edge that is configured to be disposed parallel with a ground surface when the golf club head is at address, wherein the face insert is formed of a material having a hardness of less than 95 Shore A, and wherein the rear wall includes a plurality of slots formed therethrough.

8. The golf club head of claim 7, wherein the core is formed by an additive manufacturing process.

9. The golf club head of claim 7, wherein the core includes a plurality of ribs and a plurality of channels that curve downwardly toward the sole within the heel region and the toe region.

10. The golf club head of claim 9, wherein each slot of the plurality of slots is in fluid communication with at least one channel of the plurality of channels.

11. The golf club head of claim 9, wherein the core of the face insert is surrounded by and spaced inwardly from the periphery.

12. The golf club head of claim 9, wherein the plurality of ribs extend at an inclined angle between the front wall and the rear wall.

13. The golf club head of claim 9, wherein, when the face insert impacts a golf ball heelward of a geometric center, the core of the face insert is configured to impart a corrective cut spin, and when the face insert impacts a golf ball toeward of the geometric center, the core of the face insert is configured to impart a corrective draw spin.

14. The golf club head of claim 7, wherein the periphery of the face insert includes an upper edge that is opposite the lower edge, and a thickness of the face insert varies between the upper edge and the lower edge.

15. A golf club head, comprising:

A body including a top portion that is opposite a sole, a toe region, a heel region, a medial region that extends between the heel region and the toe region, and an insert cavity at a front side; and a face insert that is integrally formed to include a front plate, a rear plate, and a core, the face insert defining a periphery that includes a lower edge that is configured to be disposed parallel with a ground surface when the golf club head is at address, and the face insert defining a geometric center within the medial region, wherein the face insert is received within the insert cavity of the body, wherein the core includes a plurality of ribs extending at an inclined angle relative to the sole between the front plate and the rear plate and extending concavely relative to the sole from the heel region to the toe region, wherein the plurality of ribs define a plurality of channels, wherein the plurality of channels comprise at least about 40% of a face insert volume, and wherein at least one rib defines a dimension that is different from a corresponding dimension of at least one other rib.

16. The golf club head of claim 15, wherein the plurality of ribs are curved downwardly within the heel region and the toe region.

17. The golf club head of claim 15, wherein the face insert is formed of a material having a hardness of less than 95 Shore A.

18. The golf club head of claim 15, wherein, when the face insert impacts a golf ball heelward of the geometric center, the core of the face insert is configured to impart a corrective cut spin, and when the face insert impacts a golf ball toeward of the geometric center, the core of the face insert is configured to impart a corrective draw spin.

19. A golf club head, comprising:

A body including a top portion that is opposite a sole, a toe region, a heel region, a medial region extending between the toe region and the heel region, and an insert cavity at a front side; and a face insert that includes a front wall and a core, the face insert defining a periphery that includes a lower edge that is configured to be disposed parallel with a ground surface when the golf club head is at address, wherein the core includes at least one rib extending concavely relative to the sole from the heel region to the toe region, and wherein the face insert comprises a plurality of openings in communication with the core, wherein a portion of the insert cavity is configured to enclose at least one opening of the plurality of openings, and wherein a portion of the periphery encloses the core between the front wall and the body.

20. The golf club head of claim 19, wherein the plurality of openings are defined by a plurality of channels exposed on a rear side of the face insert.

21. The golf club head of claim 19, wherein the plurality of openings are formed through the periphery of the face insert.

22. The golf club head of claim 19, wherein the plurality of openings are in communication with a plurality of cavities of the core.

* * * * *